US005331893A

United States Patent [19]

Wieland

[11] Patent Number: 5,331,893

[45] Date of Patent: Jul. 26, 1994

[54] METHOD AND APPARATUS FOR THE ACCURATE REGISTERING AND MOUNTING OF PRINTING PLATES

[75] Inventor: Erich G. Wieland, Würzburg, Fed. Rep. of Germany

[73] Assignee: Koenig & Bauer Aktiengesellschaft, Wurzburg, Fed. Rep. of Germany

[21] Appl. No.: 69,186

[22] Filed: May 28, 1993

[30] Foreign Application Priority Data

May 30, 1992 [DE] Fed. Rep. of Germany ..... 4217941

[51] Int. Cl.[5] ..... B41L 3/02

[52] U.S. Cl. ..... 101/486; 101/481; 101/DIG. 36

[58] Field of Search ..... 101/378, 382.1, 383, 101/389.1, 401.1, 415.1, 481, 485, DIG. 36, 486; 33/614, 616, 617, 620; 156/384, 385, 386, 387, 388

[56] References Cited

U.S. PATENT DOCUMENTS

| | | | |
|---|---|---|---|
| 2,590,044 | 3/1952 | Schaller | 101/382.1 |
| 2,663,349 | 12/1953 | Albrecht | 156/46 |
| 3,186,336 | 6/1965 | Kirby | 101/216 |
| 3,481,270 | 12/1969 | Schaeffer | 101/401.1 |
| 3,515,617 | 6/1970 | Schaeffer | 156/388 |
| 3,565,001 | 2/1971 | Zimmer | 101/378 |
| 4,449,452 | 5/1984 | Mansell | 101/389.1 |

FOREIGN PATENT DOCUMENTS

| | | |
|---|---|---|
| 1273542 | 7/1966 | Fed. Rep. of Germany . |
| 1561185 | 6/1967 | Fed. Rep. of Germany . |
| 1299651 | 11/1967 | Fed. Rep. of Germany . |

*Primary Examiner*—Edgar S. Burr
*Assistant Examiner*—Ren Yan
*Attorney, Agent, or Firm*—Jones, Tullar & Cooper

[57] ABSTRACT

A method and apparatus for the registered application of printing plates to a printing cylinder applies the printing plates to the jacket face of the printing cylinder exactly registered and free of bubbles and warping. The printing plate is clamped in a frictionally connected manner in a stretched position by holding arms and is exactly registered in a horizontal and vertical set position. The plate is then aligned and spaced apart from the printing cylinder and is maintained in a frictionally connected manner. Subsequently, the printing plate is brought into line contact with the jacket and is then pressed against it. The printing plate is pressed down against the cylinder jacket, starting at the contact line, and the pressing force is then applied to the plate circumferentially around the cylinder from the initial contact line.

8 Claims, 17 Drawing Sheets

12
177
178
132
144
104
137
133
116
XXI
179
176
51
78; 66
z
107

METHOD AND APPARATUS FOR THE ACCURATE REGISTERING AND MOUNTING OF PRINTING PLATES

FIELD OF THE INVENTION

The present invention is directed generally to a method and apparatus for the accurate registering and mounting of a printing plate. More particularly, the present invention is directed to a method and apparatus for accurately registering and mounting of flexible printing plates on the jacket surface of a printing cylinder. Most specifically, the present invention is directed to a method and apparatus for accurately registering and mounting a printing plate on the jacket surface of a printing cylinder for flexographic printing presses. The printing cylinder is positioned in a support that also carries a locating shield which can accurately support a transparent proof of the product to be printed. The flexible printing plate that is to be secured to the plate cylinder is initially secured to a suction fork assembly. The suction fork assembly and the locating shield are superimposed in front of the cylinder and the flexible printing plate is located on the suction fork assembly using the locating shield as a guide. Once the printing plate on the suction fork has been properly aligned or registered, it can be applied to the periphery of the forme cylinder in proper registry by using a pressure applying assembly.

DESCRIPTION OF THE PRIOR ART

The accurate positioning or registering of a printing plate on the surface of a printing plate or forme cylinder has always been an important element in the attainment of quality printing procedures. Particularly in a situation where multiple printing plates are required for the production of a multiple color finished product and where each color is applied to the product in a sequential manner by different plates on different cylinders, the accurate positioning or registration of each plate on each cylinder is of paramount importance. Register errors give rise to superimposed colors or spaces with no color. Thus it is very important that each printing plate be placed on the plate cylinder in accurate register.

German patent No. 15 61 185 provides an assembly which allows the printing plate to be adjusted in three directions or degrees of freedom, namely horizontally, vertically and by rotation. In this device, the printing plate is positioned with its undersurface on a stationary, curved register plate and is held against the register plate by a suitable suction force. A curved or bent mounting plate which consists of a transparent proof of the desired resultant printed product, is pivoted or otherwise moved over the printing plate. The printing plate that is held on the register plate is then brought into register with the transparent proof. After this registration has been accomplished, the printing plate is transferred with its printing side, such as a relief side, to the mounting plate, through the use of suction. In the meantime, the suction air supply on the register plate is turned off. This allows the printing plate to now be supported on the mounting plate with its undersurface exposed. The mounting plate with the attached printing plate can now be moved away from the register plate and moved in an axial direction in relation to the forme cylinder into a position where it can be glued or otherwise adhered to the forme cylinder. The printing plate is then glued to the forme cylinders and the suction to the mounting plate is turned off so that the mounting plate can be moved away from the forme cylinder.

A limitation of this prior art device is that the printing plate, which has been registered on the register plate to which it was initially attached, is transferred to the mounting plate. This single transfer creates registration inaccuracies that result in printing errors. This is due partly to the fact that it is the relief or printing side of the printing plate that is brought into engagement with the mounting plate as the printing plate is transferred from the register plate to the mounting plate.

If this prior art device is used with a flexible printing plate, the suction forces will deform the plate and this will add to the register errors. Also, this prior device allows trapped air or wrinkles to be formed during gluing. Further, if long, narrow plates are used, they can shift or move laterally.

It will be seen that a need exists for a procedure to accomplish the accurate register and mounting of printing plates. The method and apparatus for accurate registration and mounting of printing plates on forme cylinders in accordance with the present invention provides such a procedure and is a significant advance over the prior art devices and procedures.

SUMMARY OF THE INVENTION

It is an object of the present invention to provide a method and apparatus for registration and mounting of printing plates on printing cylinders.

Another object of the present invention is to provide a method and apparatus for accurately registering and mounting flexible printing plates on printing cylinders.

A further object of the present invention is to provide a method and apparatus for accurately registering and mounting flexible printing plates on jacket surfaces of printing or forme cylinders.

Still another object of the present invention is to provide a method and apparatus for accurately registering and mounting flexible printing plates on forme cylinders free of bubbles and distortions.

Even a further object of the present invention is to provide a method and apparatus for accurately registering and mounting printing plates of different lengths, even of lengths which take up the entire circumference of the printing cylinder.

As will be discussed in greater detail in the description of the preferred embodiment which is set forth subsequently, the method and apparatus for accurately registering and mounting flexible printing plates on the jacket surface of forme cylinders in accordance with the present invention starts by positioning the forme cylinder on a support assembly. A locating shield or registration screen is positioned at one end of the support assembly. This shield or screen can receive a transparent proof of the product to be printed with this transparent proof being positionable in proper register. The flexible printing plate that is to be secured on the forme cylinder is supported at its upper and lower edges between spaced suction arms of a suction fork assembly. This suction fork assembly is movable to shift the flexible printing plate horizontally, vertically, and to rotate it about a center. The suction fork and the locating shield are placed in a superimposed position and the flexible plate is adjusted or repositioned while being held on the suction fork by using the locating shield as a guide. Once the flexible printing plate is properly positioned on the suction fork, this assembly can be moved to bring the printing plate into engagement with the forme cylinder. As soon as the plate has contacted the cylinder along a tangent line, a pressure device that utilizes one or more rollers which are rotatably supported between spaced arms is brought into engagement with the printing plate. The spaced arms are moved by drive motors to cause the rollers to apply pressure against the printing plate as it is smoothly positioned on the surface of the printing cylinder.

A significant advantage of the method and apparatus of the present invention is that the flexible printing plate is positioned on the suction arms of the suction fork in a planar manner and is not then moved or shifted with respect to the suction arms during registration. While the suction arms are movable as a unit, the flexible plate is not shifted with respect to the arms. This ability of the suction fork to shift in three degrees of freedom and to move into position with respect to the forme cylinder while not shifting the printing plate with respect to the suction arms provides a highly accurate registration of the printing plate. The high degree of accuracy is maintained during the transfer of the printing plate to the forme cylinder. In contrast with the prior art devices, once the printing plate has been positioned on the suction fork assembly, it is not moved relative to the fork assembly until it is transferred to the forme cylinder. The additional transfer steps required in the prior art, as well as the holding of the printing plate on its relief or printing side are avoided by the present invention. Once the printing plate has been moved into position in line contact with the plate cylinder, the pressure assembly applies a continuous circumferentially moving force to properly place the plate on the surface of the cylinder.

It will be seen that the method and apparatus for accurate registration and mounting of the printing plates on forme cylinders in accordance with the present invention overcomes the limitations of the prior art and provides a procedure and process which is a substantial advance in the art.

BRIEF DESCRIPTION OF THE DRAWINGS

While the novel features of the method and apparatus for accurate registration and mounting of printing plates in accordance with the present invention are set forth with particularity in the appended claims, a full and complete understanding of the present invention may be had by referring to the detailed description of the preferred embodiments, which are presented subsequently, and as illustrated in the accompanying drawings, in which:

DESCRIPTION OF THE PREFERRED EMBODIMENT

Presently, cardboard products which have multiple color printing are frequently designed in printing firms through the use of CAD installations. These designs are accomplished so that the form of the punching cuts, the positioning of the folds and imprints, the lengths of the repeats and the like are determined for this material in a plane condition. The uppermost paper ply of what will be a corrugated cardboard carton is printed in its multiple color configuration and is then secured to the underlying corrugated cardboard. The uppermost layer of paper which will become the covering ply for this kind of corrugated cardboard product is frequently produced in a common impression flexographic press with six inking units. The data from the CAD generated designs are usable for effecting the positioning of the imprints and the circumferential length of the repeats.

It is necessary that the printing plates, which will be used to print these multiple color covering plies of paper, be mounted on the plate or forme cylinder in accurate register. The present invention is utilized to accomplish this register accurate registering and mounting of the printing plates on the forme cylinder. The printing cylinders are taken out of the flexographic printing press and are handled by an apparatus and in a manner as set forth hereinafter.

Figure 1:
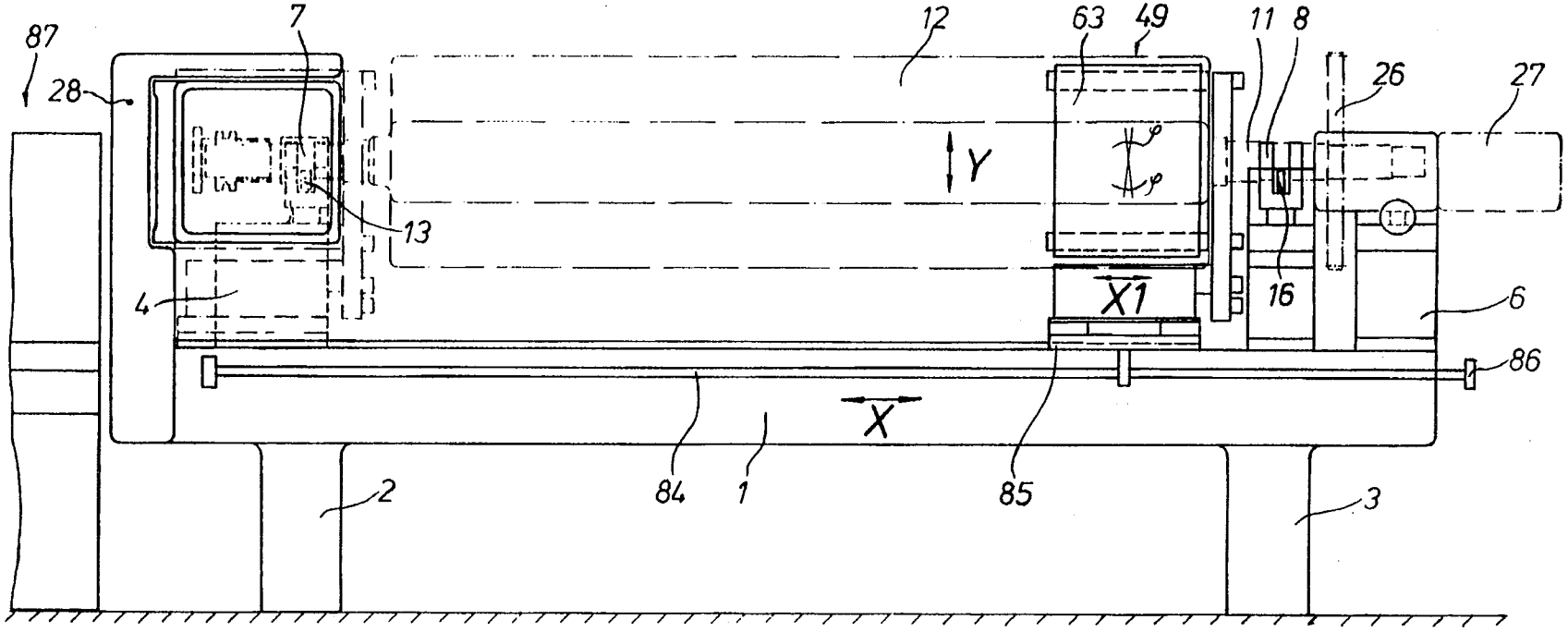
FIG. 1 is a front view of an apparatus for accomplishing the accurate registration and mounting of a printing plate on a printing cylinder in accordance with the present invention.

Referring initially to FIG. 1, there may be seen an apparatus in accordance with the present invention for accomplishing the accurate registration and mounting of printing plates on a plate cylinder. The assembly utilizes a machine frame 1 which is supported by spaced support feet 2 and 3. A pair of upwardly extending bearing brackets or pillow blocks 4 and 6 that have bearing supports or holders 7 and 8 are used to receive the axle trunnions or journals 9 and 11 of a forme or printing cylinder 12 to which the flexible printing plates will be secured. It will be understood that the forme cylinder 12 has been removed from the press assembly in which it normally operates and has been placed on the machine frame 1. The bearing supports 7 and 8 have spaced rolls 13, 14, 16 and 17 which receive and support the axle trunnions 9 and 11 of the forme cylinder 12.

Figure 2:
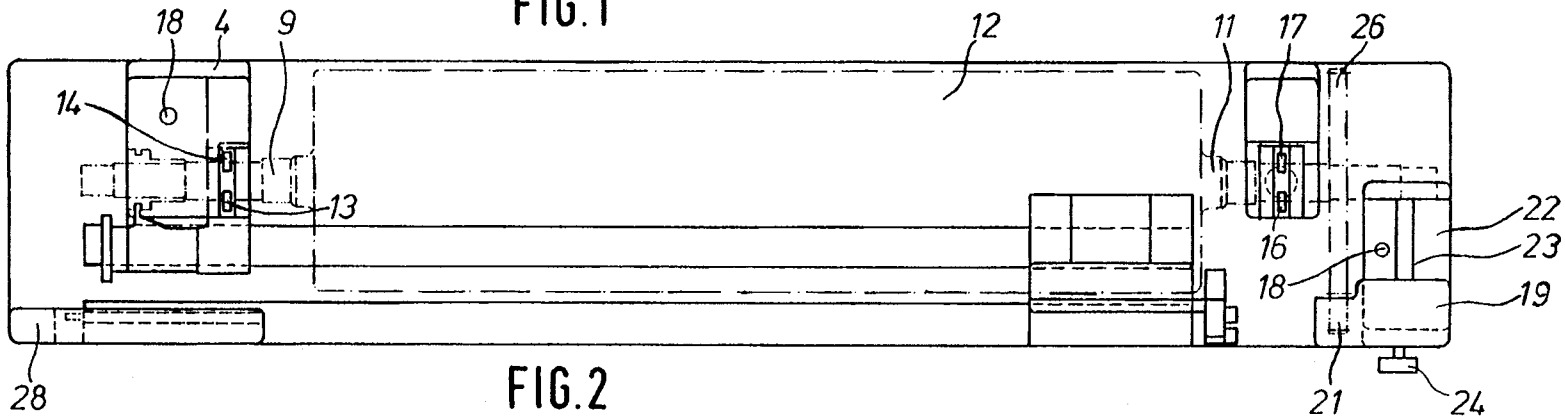
FIG. 2 is a top plan view of the apparatus of FIG. 1.

A first bearing bracket or pillow block 6 is securely attached to the machine frame 1 while a second bearing bracket or pillow block 4 is shiftable along a guide support (not specifically shown) in the axial direction of the forme cylinder 12. This allows the machine frame 1 to accommodate forme cylinders 12 of varying lengths. A suitable clamping screw 18 is used to lock the axially adjustable second bearing bracket 4 at a desired position. The first bearing bracket 6 may be provided with a drive assembly 19 that includes a drive motor, a gear, an impulse transmitter, and a pinion 21. The drive assembly 19 is arranged in a support 22 and can be shifted so that the pinion 21 engages the drive gear 26 of the forme cylinder 12. This will allow the forme cylinder 12 to be rotated while it is being supported in the machine frame 1. The drive assembly 19 can be moved on support 22 by means of a threaded spindle 23 and an adjustment wheel 24, as is shown more clearly in FIG. 2. Alternatively, the forme cylinder 12 could be rotated by a drive assembly attached to the axle trunnion 11. This is shown in FIG. 1 in dashed lines at 27. This drive assembly 27 could include a drive motor, a gear, and an impulse transmitter.

Figure 4:
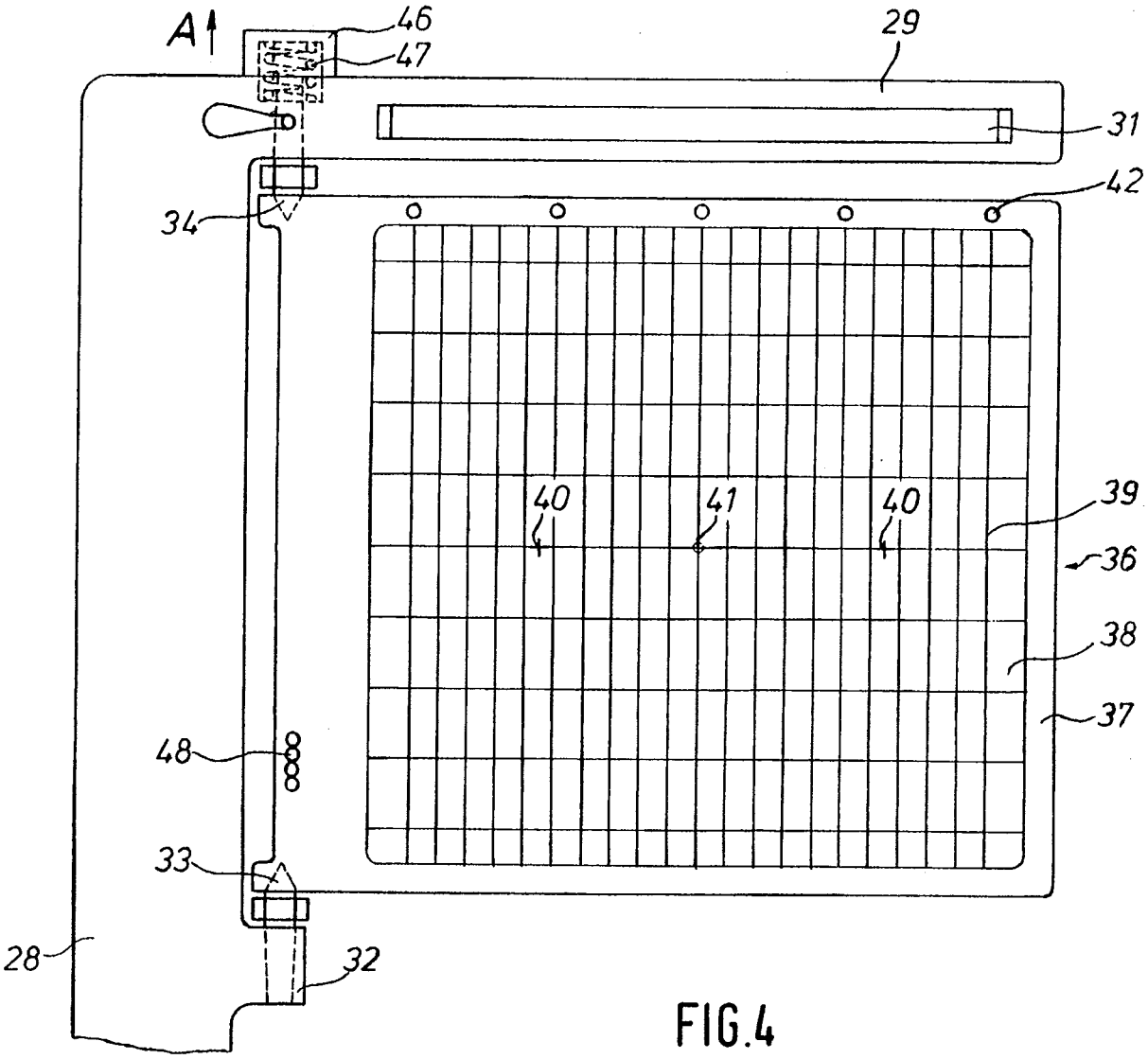
FIG. 4 is a detailed front elevation view of a locating shield or registration screen in accordance with the present invention.
Figure 3:
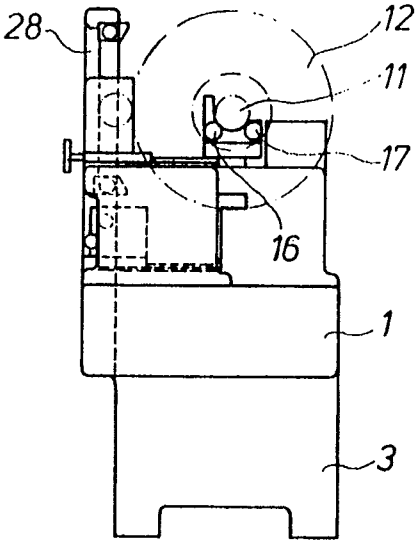
FIG. 3 is an end view of the apparatus taken from the right as seen in FIG. 1.

Referring again to FIGS. 1 and 2, and also turning to FIG. 4, there is shown a locating shield or registration screen for use in the apparatus of the present invention. The machine frame 1 has at its end adjacent the second or adjustable bearing bracket 4 a generally vertical arm 28 which terminates at its upper end portion in a generally horizontally extending connecting bar 29. This connecting bar 29 carries an elongated tubular lamp 31, such as a fluorescent lamp with an anti-glare shade. A first vertical bore is formed in the connecting bar 29 generally adjacent the vertical arm 28 and a second vertical bore is formed in a nose 32 on the arm 28. These two vertical bores are in vertical alignment and receive bearing bolts 33 and 34 which are provided with tapered cones at their ends which face each other, all as is shown most clearly in FIG. 4. These cones are receivable in and pivotably support an inboard end of a registration screen, generally at 36. This registration or locating screen 36 consists of a frame 37 that supports a transparent pane 38. The transparent pane 38 has horizontally and vertically extending register lines 39. A zero point 41 and two register crosses 40 are delineated on the transparent pane 38. The upper horizontal member of frame 37 is provided with a plurality of spaced pins 42 that are used to receive the registration foil. The upper bearing bolt 34 is movable generally vertically by actuation of a double armed lever 44 which is supported on a pivot 43, as may be seen in FIG. 7. A counteracting spring 46 that is carried in a housing 47 on the horizontal connecting bar 29 exerts a downward force against the upper bearing bolt 34. This assembly allows the upper bearing bolt 34 to be elevated so that a particular registration screen 36 can be removed and another registration screen 36 substituted for it. These various exchangeable registration screens 36 are each provided with individual, different identification marks 48, such as with visible numbers or with various sensors that can be scanned electronically. A suitable registering of the number 48 or mark can also be accomplished by a generally known register mark reader or by means of a suitable video system.

Figure 5:
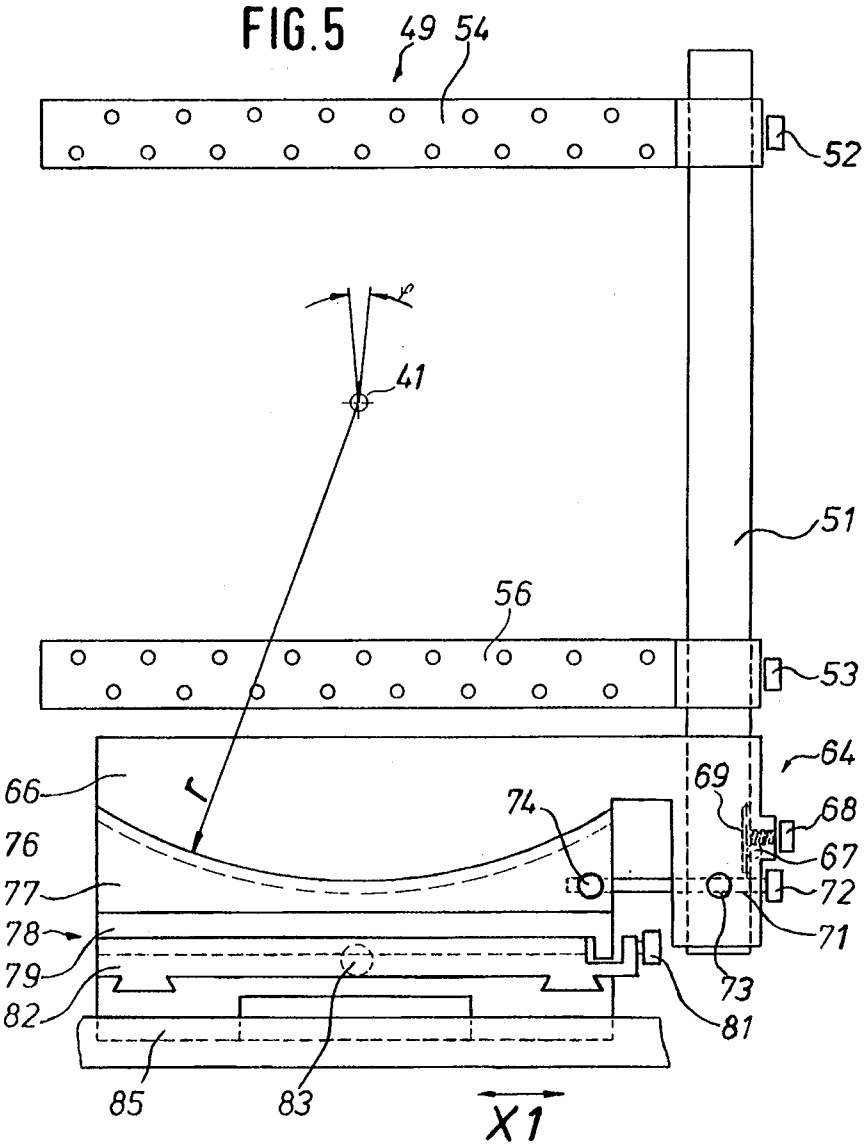
FIG. 5 is a front elevation view of a suction fork assembly.
Figure 6:
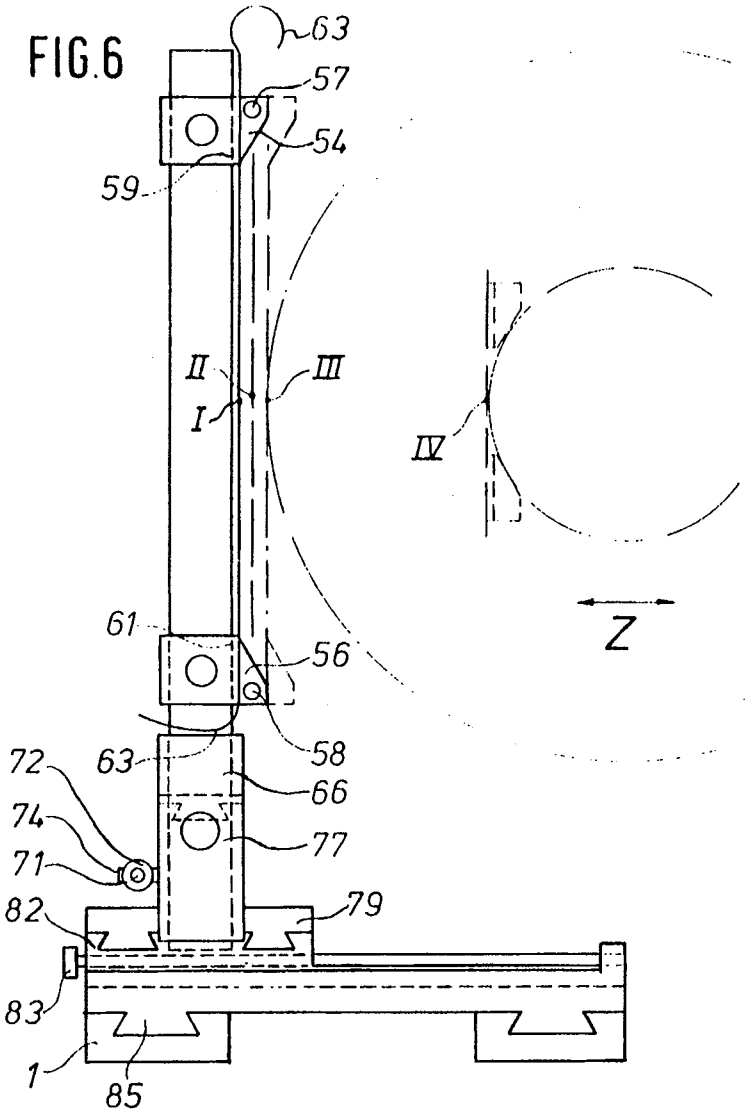
FIG. 6 is an end view of the suction fork of FIG. 5.

Turning now to FIGS. 1, 5 and 6, there is shown generally at 49 a suction fork assembly whose purpose is to securely yet shiftably support a flexible printing plate 63 which will be brought into proper register in cooperation with the registration screen 36 so that the plate 63 can then be applied to the surface of the forme cylinder 12. The suction fork assembly, generally at 49, is shown in FIG. 1 in its initial position at the right end of the machine frame 1, generally adjacent the stationary bearing bracket 6. It will be understood that the suction fork assembly 49 is shiftable along the machine frame 1 in the direction indicated by X as a unit. The suction fork assembly 49 is also movable horizontally and vertically with respect to the machine frame 1 in the direction indicated at X1 and Y and can be moved toward and away from the periphery of the forme cylinder 12 in the direction indicated by the arrow Z in FIG. 6. The suction fork assembly 49 can also be rotated in a plane defined by spaced suction arms 54 and 56 through an angle $\phi$ as depicted in FIG. 5. These various degrees of freedom of movement of the suction fork assembly 49 are effective to allow a flexible printing plate 63 supported by the suction fork assembly 49 to be properly positioned or registered through the use of the registration screen so that the registered printing plate 63 can then be accurately applied to the forme cylinder 12.

Referring now primarily to FIG. 5, the suction fork assembly, generally at 49 uses spaced upper and lower, horizontally extending suction arms 54 and 56, respectively, which are adjustably secured by clamp screws 52 and 53 to a vertically extending pillar 51. These upper and lower suction arms 54 and 56 are, as may be seen in FIG. 6, generally triangular in cross-section and each has a suction air connection 57 or 58, respectively. Each suction arm 54 and 56, has a plurality of suction holes 62 distributed over contact areas 59 and 61, respectively. These contact areas 59 and 61 can be provided with a corrugated surface or a powder coated surface so that they will provide a higher coefficient of friction with respect to the surface of a printing plate 63 which will be adhered to these contact areas 59 and 61 by the use of suction air through the suction holes 62. As may be seen in FIG. 6, the printing plate 63 may have a height that is greater than the spacing of the upper and lower suction arms 54 and 56. However, only a sufficient portion of the printing plate 63 required to effect accurate register of the plate need be supported between the spaced suction arms 54 and 56.

Referring again to FIGS. 5 and 6, the vertical pillar 51 of the suction fork assembly 49 is supported by an angular adjustment support 66 so that its upper end can be moved to the left or right, as seen in FIG. 5 to thereby effect a rotation of the plane defined by the suction arms 54 and 56 through the angle $\phi$ about the center point 41, as seen in FIG. 5. The pillar 51 is also shiftable vertically in the direction X since its lower end is received in a vertical adjusting assembly 64. The angular adjustment support 66 is in the form of an arc of a circle having a radius "r" whose origin is the center point between the suction arms 54 and 56 and which corresponds generally to the zero point 41 of the locating shield 36 of FIG. 4. The vertical adjusting assembly 64 for the pillar 51 of the suction fork 49 utilizes a worm wheel 67 which is driven by a hand wheel or a motor 68. The worm wheel 67 engages a toothed rod 69 that is attached to the pillar 51. It will be understood that if the worm wheel 67 is driven by a motor 68 that the motor 68 can be controlled by the control desk of the assembly of the present invention.

The pivotable or angular motion of the suction fork assembly 49 through the angle $\phi$ is accomplished by the use of a threaded spindle 71. A first end of the spindle 71 is driven by a suitable handle wheel or motor 72 and a second end of the spindle 71 is received in a threaded gimbal or ball joint bearing 74 that is secured to a receptacle portion 77 of the suction fork 49. A threaded sprocket 73 is used to support the threaded spindle intermediate the vertical adjusting assembly 64 and the receptacle part 77. Since the receptacle 77 is generally fixed, and the vertical adjustment assembly 64 is secured to the angular adjustment support 66, rotation of the threaded spindle will cause the angular adjustment support 66 and hence the pillar 51 to pivot through the angle $\phi$. This angle is generally in the range of 3° to either side of the vertical.

As may be seen in FIGS. 5 and 6, the angular adjustment support 66 is carried by the receptacle 77 by way of a dove-tail guide slot 67. This allows the angular adjustment support 66 to slide in the receptacle 77 without experiencing any unwanted motion. The receptacle 77 is part of a cross-table which is designated generally at 78 and which is utilized to accomplish the horizontal shifting of the suction fork 49 in the direction X1 with respect to the machine frame 1 with this direction X1 being shown in FIG. 2. This cross table 78 is also able to accomplish the shifting of the suction fork 49 in the front to rear direction Z with respect to the forme cylinder 12, as depicted in FIG. 6. To accomplish the longitudinal or axial adjustment movement X1, the cross table 78 is provided with a support 79 which can be actuated by an adjustment screw through the use of a hand wheel or motor 81. This adjustment screw is rotatably supported by a support bed 82 and is threaded into the support element 79. The support element 79 is slidable in a dove tail guide portion of the support bed 82. Thus rotation of the adjusting screw and motor or hand wheel will shift the support element 79 in the direction X1 with respect to the support bed 82. The support bed 82 is, in turn, slidably supported by suitable dove tail guides on a positioning support 85. The support bed 82 is movable in the direction Z, as seen in FIG. 6 toward and away from the forme cylinder 12 by actuation of a suitable threaded lead screw 83 and an accompanying hand wheel or drive motor. Actuation of this lead screw 83 will thus shift the support bed 82 with respect to the positioning support 85. The positioning support 85 is supported, in turn, in dove tail guide slots in the machine frame 1, as seen in FIGS. 6 and also as seen in FIG. 1. Movement of the positioning support 85 along the machine frame 1 is done by a lead screw 84 with a hand wheel or motor 86 and accomplishes the shifting of the suction fork assembly 49 along the machine frame in the direction X whereas the movement of the support bed in the direction Z; movement of the support 79 in the direction X1; movement of the pillar 51 in the direction Y; and movement of the angular adjustable support 66 in the angular direction $\phi$ all effect a shifting of the suction arms 54 and 56 of the suction fork assembly 49 with respect to the machine frame 1. All of the various hand wheels and lead screws 68, 72, 81, 83 and 86 can be provided with suitable motor drives, each of which is connected with an impulse transmitter. All of these drive motors can be controlled from a central point, such as the control desk 87 of the assembly. This control desk 87 may include a computer having a screen, and keyboard as well as suitable control equipment for use in controlling the vacuum or suction installations and the like.

The method of operation of the apparatus for accomplishing the accurate registration of printing plates on forme cylinders in accordance with the present invention will now be discussed in detail. A printing plate 63 whose proper register is to be effected, is secured to the suction fork assembly 49 by placement against the contact areas 59 and 61 of the suction arms 54 and 56 and the application of a suction force to the suction holes 62. The printing plate 63 is applied to the suction arms 54 and 56 with its relief or printing face oriented away from the contact areas 59 and 61. The printing plate 63 is held by the suction arms 54 and 56 in a generally planar orientation. The suction fork assembly 49 is then moved across the machine frame 1 until it is positioned behind and in alignment with the registration screen 36 upon which has been positioned a transparent proof of a printing plate 63. This transparent proof of printing plate 63 has been attached to the registration screen 36 by means of adhesive tapes, vacuum holders, static electrical friction or the like. The transparent proof of the printing plate 63 may be properly registered on the transparent screen 38 of the registration screen 36 through the utilization of the register lines 39 on the screen 38 and the use of the reference crosses 40 and the zero point 41.

Once a transparent proof of a particular printing plate 63 has been secured to its registration screen 36 in proper register, it will remain on that registration screen 36. In other words, a particular registration screen 36 has one transparent proof secured to it. If another printing subject is to be properly registered, the registration screen 36 bearing the transparent proof of the first subject is removed by the actuation of the bearing bolt 34 and a different registration screen 36 is put up in its place. Each individual registration screen 36 can be identified by its unique identification marks 48, as was discussed previously.

The suction fork assembly 49 is moved into superimposed position with the locating shield 36 in a register position identified as position I in FIG. 6. In this position, the suction fork assembly 49 will be shifted or rotated in the X1, Y or $\phi$ directions to accomplish the exact register position of the printing plate 63 while using the transparent proof on the registration screen 36 as a guide. Once this exact register has been accomplished, as may be done using data from the CAD installation into the computer in the control desk 87 and thence to the various motors for the lead screws of the suction fork assembly 49, the suction fork assembly 49 can then be moved by the drive 86 to the transport level II or transport position II as shown in FIG. 6. In this transport position, the suction fork assembly 49 has moved from its congruent or superimposed position behind registrations screen 36 to the position shown in FIG. 1.

Once the suction fork assembly 49 is in the transport position II, the drive means 83 is used to move the support bed 82 in the direction Z of FIG. 6 to the tangential gluing position indicated at either position III or position IV. Position III indicates the tangential gluing position of a printing plate 63 with respect to a forme cylinder 12 having a maximum diameter that can be accommodated by the print drive, while Position IV indicates the tangential gluing position of a printing plate 63 with respect to a forme cylinder 12 having a minimum diameter that can be accommodated by the present device.

Once the reverse side of the printing plate 63, which is provided with a suitable adhesive coating, has been brought into tangential contact with the periphery of the forme cylinder 12 in either Positions III or IV, as depicted in FIG. 6, the suction air to the suction arms 54 and 56 of the suction fork assembly 49 can be shut off by a suitable switch or control means. The printing plate 63 can then be pressed, either by hand or by suitable mechanical means such as pneumatic press-on rolls or brushes, against the surface of the forme cylinder 12 in a properly registered position.

Figure 7:
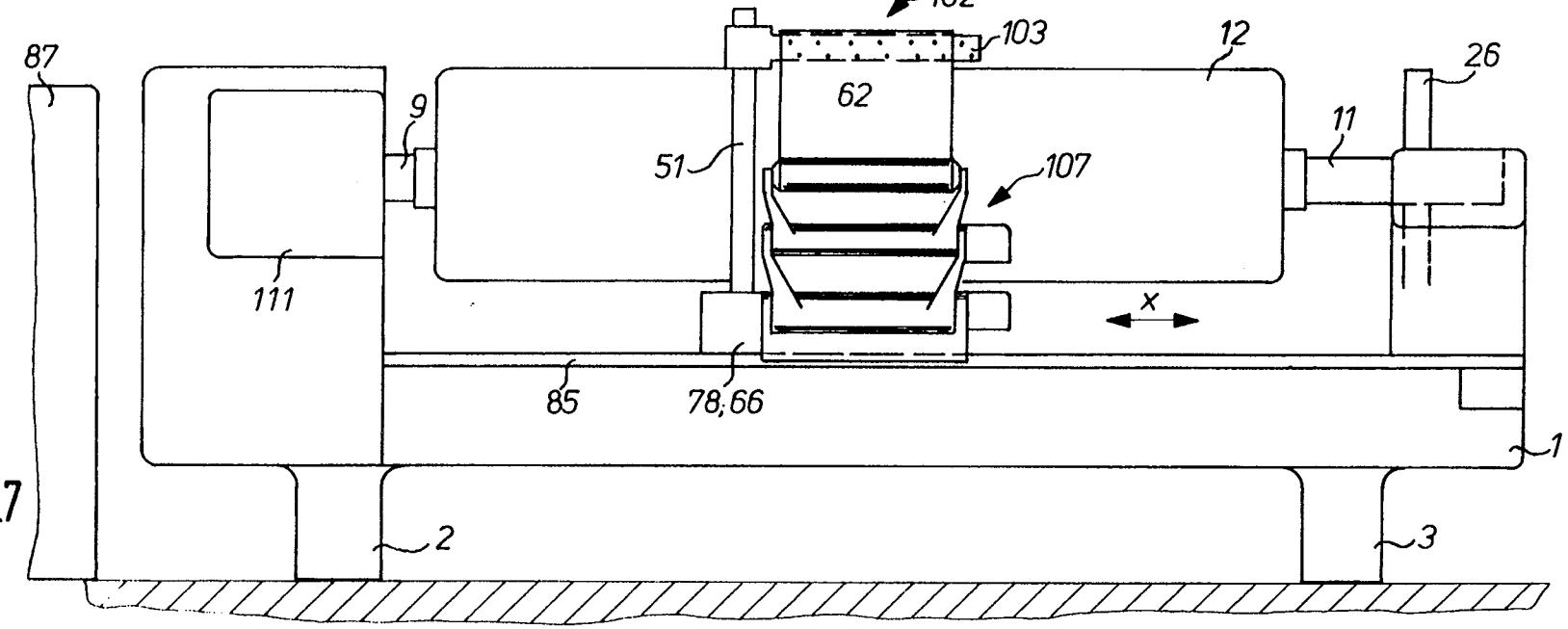
FIG. 7 is a front view of a pressure device for applying printing plates to a printing cylinder in accordance with the present invention.
Figure 8:
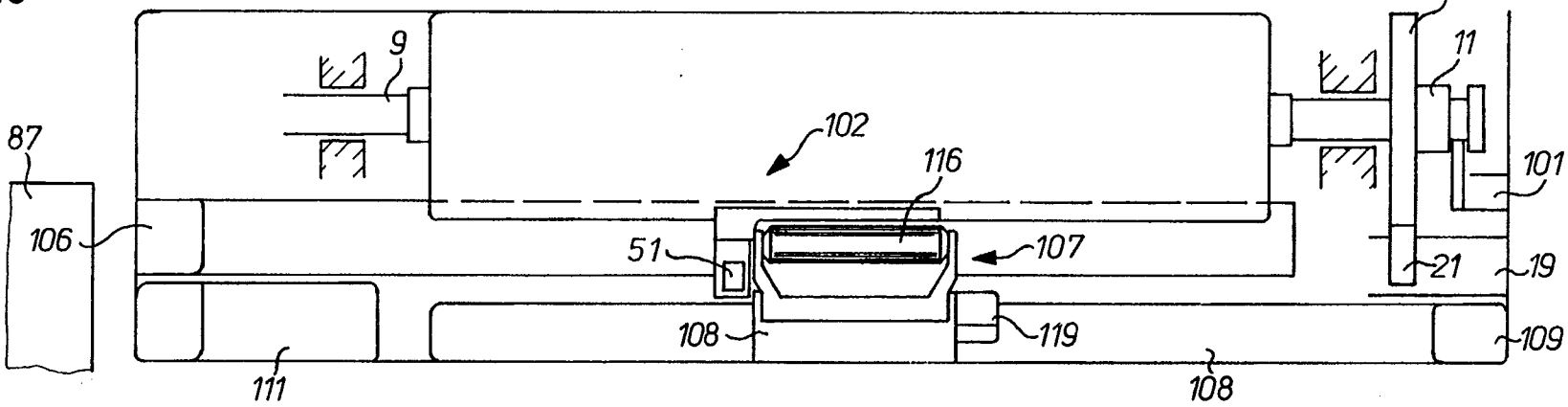
FIG. 8 is a top view in accordance with FIG. 7.
Figure 9:
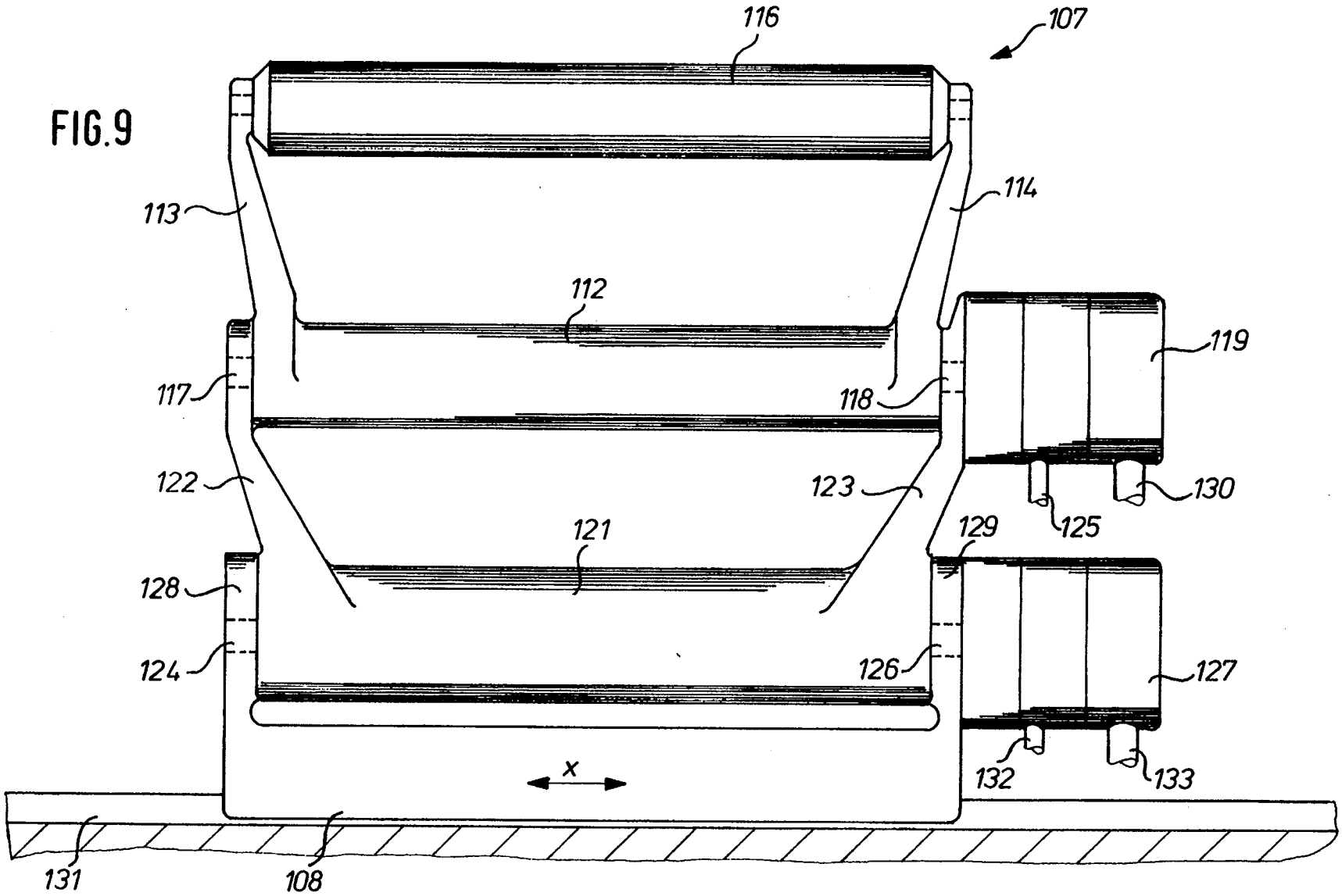
FIG. 9 is a detailed view of a pressure device in accordance with FIG. 7.
Figure 10:
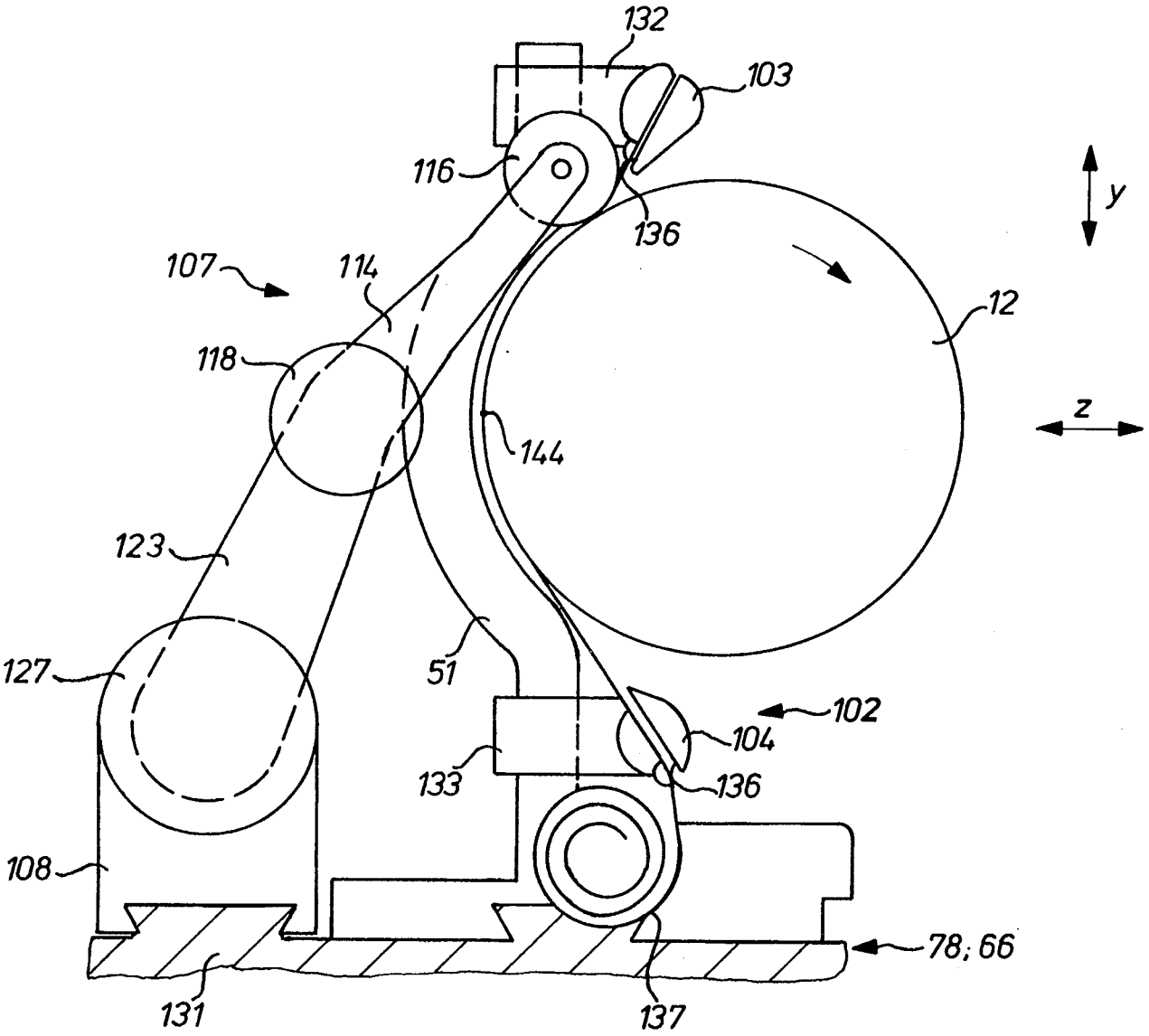
FIG. 10 is an end view in accordance with FIG. 9, and with the suction fork added.
Figure 11:
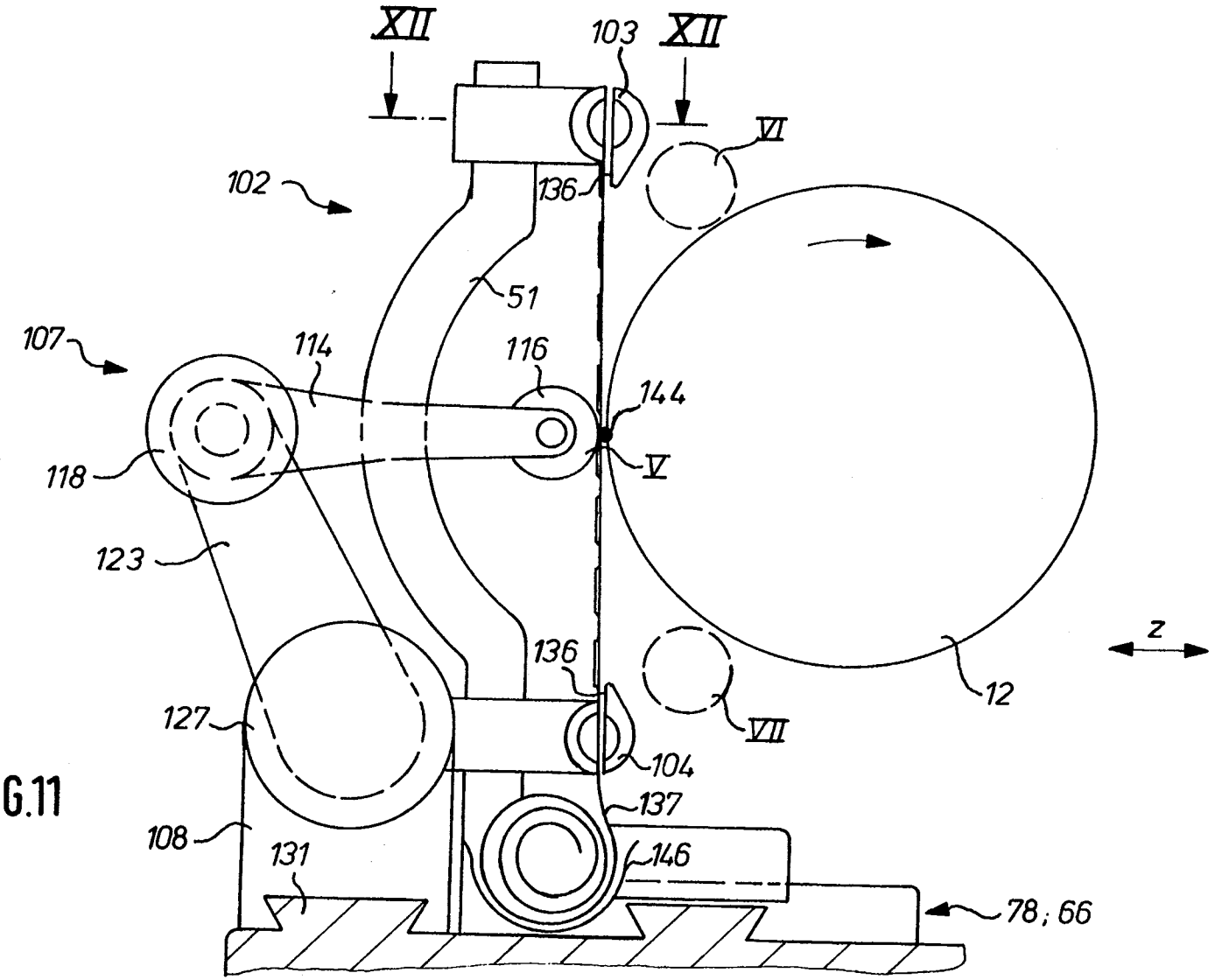
FIG. 11 is a view similar to FIG. 10, and in a different working position.

Referring now to FIGS. 7–13 there is shown a first preferred embodiment of a flexible printing plate application or pressure applying assembly in accordance with the present invention. A side view of the first preferred embodiment of the pressure device in accordance with the invention for applying a printing plate is shown in FIG. 7 and a top view is shown in FIG. 8. The machine frame 1 with bases 2, 3 supports the printing cylinder 12 with its axle journals 9, 11. The axle journal 11 has a lateral guide 101 fixed on the frame and is connected in a frictionally connected manner by a toothed drive wheel 26 and a pinion 21 with a drive 19 for the printing cylinder 12. A suction fork, generally at 102, which is generally equivalent to suction fork 49, has two height-adjustable suction guides 103, 104 on a column 51, which are pivotably carried by support post 51, as shown in detail in FIG. 12. Analogously to FIG. 5, the column 51 is connected with a cross table 78 which receives an angular adjustment 66. Both devices 66 and 78 can be moved on a positioning support in the direction X by means of a drive 106 comprising a spindle, motor and gears. The drives for pivoting in accordance with the angle of rotation $\phi$ and the axial adjustment movement X1 as well as the radial direction Z are in accordance with the description of FIG. 5. In addition, a pressure device, identified in its entirety by 107, is shown, which is axially movable on a support 108 in the direction of the arrow X by means of a drive 109 comprising a spindle, motor and gears. An alignment device 111 for aligning the printing plate with a transparent proof copy is received in the machine frame 1 at the side of the printing cylinder 12 remote from the drive wheel 26. The operating console 87 is located at the side with alignment device 11. FIGS. 9 to 11 show the pressure device 107 and the suction fork 102 is also shown in FIGS. 10 and 11.

The pressure device 107 consists of two arms 113 and 114 fixedly disposed at first ends at spaced ends of a pivotable base body 112 and receiving a pressure roller 116 between second ends. The pressure roller 116 can have a resilient jacket, for example of foam rubber. The base body 112 can be tube-shaped and has on each of its two ends respectively an axle journal 117 or 118. The axle journal 118 is connected fixed against relative rotation with a pivot drive 119. Another pivotable base body 121 has arms 122 and 123 at either end, which are seated rotatably movable on the axle journals 117 and 118. The base body 121 can be tube-shaped and also has on each of its two ends one axle journal 124 and 126. The axle journal 126 is connected fixed against relative rotation with a pivot drive 127. The support 108, which can be displaced in the direction of the arrow X, has on each of its two ends respectively one arm 128 or 129 which are seated rotatably movable on the axles journals 124 and 126. The support 108 is movable in the direction x on a linear guide 131 by means of the drive 109.

The respective pivot drives 119 and 127 preferably consist of an electric motor, gears and an angle sensor for position indication. The respective pivot drives 119 and 127 have connectors 125 and 130 for lines for energy supply and angular position indication. In place of an electrical servo drive, a hydraulic or pneumatic drive could also be used. The controls of the pressure device 107 correspond to a path control in three axes and can be provided by means of programmable processors in the computer of the operating console 87.

In addition to the pressure device 107, the suction fork 102 is shown in FIGS. 10 and 11. The column 51 of the suction fork 102 has a curvature in the vertical direction, which approximately corresponds to the radius of the printing cylinder 12 illustrated. The suction guides 103 and 104 are kept in holders 132 and 133, which are disposed on the column 51 on brackets, not identified further, and are movable in height in the direction Y. For this purpose the holders 132 and 133 have apertures that correspond to the cross-sectional shape of the column 51.

Figure 12:
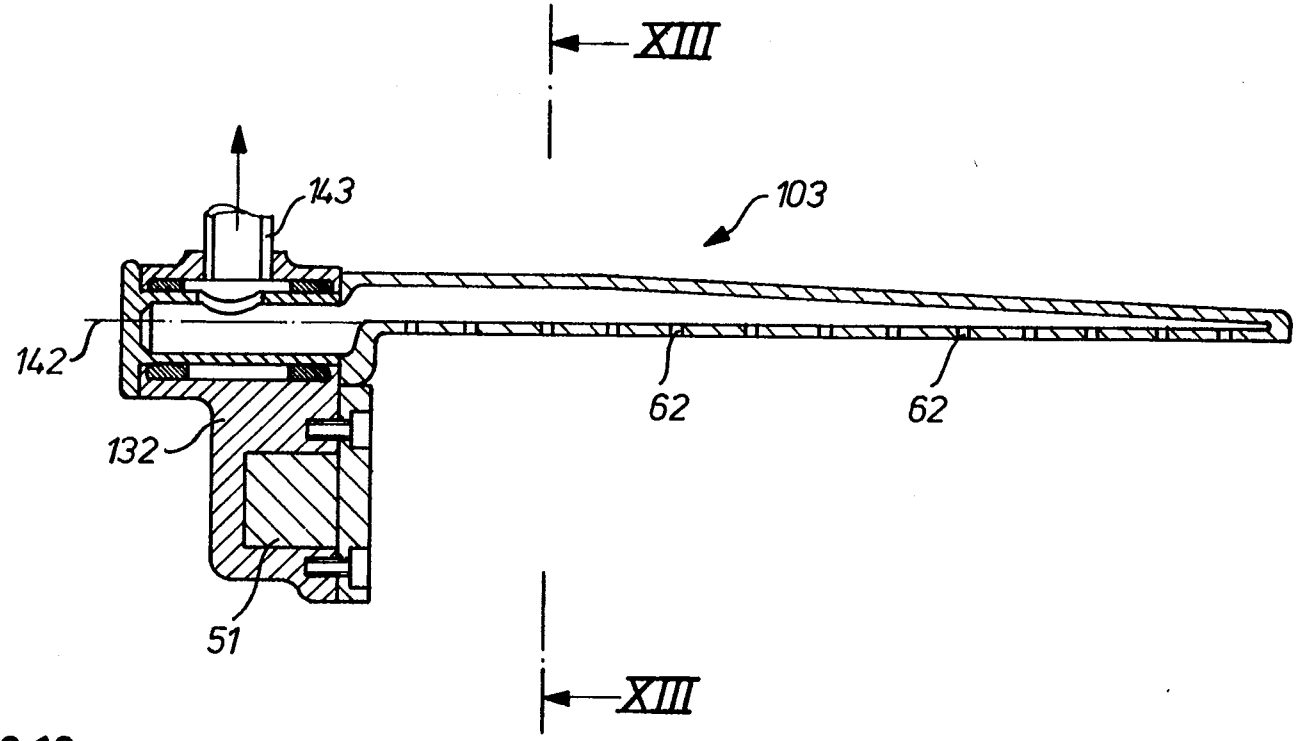
FIG. 12 is a cross-sectional view taken along line XII—XII of FIGS. 11 or 13.
Figure 13:
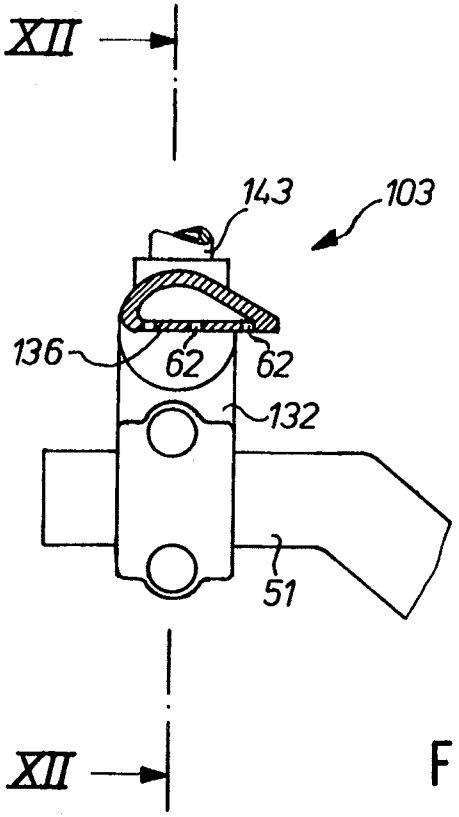
FIG. 13 is an enlarged view of the upper suction guide 103, shown rotated by 90°.

As shown in FIGS. 10 to 12, the suction guides 103 and 104 as a whole are generally bayonet-shaped and respectively have a wedge-shaped cross section at their suction portion 134, a suction surface 136 of which is in contact with the underside of a printing plate 137 to be applied to the printing cylinder 12. An end 138 of each of the suction guides 103 and 104 located in the holders 132 and 133, has a tube-shaped cross section and is rotatably or pivotably seated in rolling bearings 139 and 141. The axis of rotation 142 of the suction guides 103 and 104 extends through the plane of the suction surface 136. The suction guides 103 and 104 have suction holes 62 in the suction part 134, and the end 138 of the suction guides 103 and 104 located in the holders 132 and 133 are connected with a suction air connector 143. The pivotable suction guides 103 and 104 can be arrested in any arbitrary position by means not shown, such as clamping rings, when a printing plate is to be held by suction for the first time, for example.

Application of the printing plate 137 to the cylinder 12 takes place as described below. As shown in FIGS. 7 to 12, the printing plate 137 is held by the suction fork 102 with the suction guides 103 and 104. In this case the beginning of the printing plate 137 is in the upper suction guide 103 and the end of the printing plate 137 is held by the suction guide 104 as seen in FIG. 11. Because of the movement of the mechanical stage 78 in the direction Z toward the printing cylinder 12 there is contact between the printing plate 137 with a tangential or contact line 144 extending in the axial direction on the circumference of the printing cylinder 12. The printing cylinder 12 is provided with an adhesive foil on its jacket surface, so that the printing plate 137 sticks to it at this place. This is assisted by the movement of the pressure roller 116, as shown in FIG. 11 in position V. Through further movement of the suction fork 102 in the direction Z toward the printing cylinder 12, the underside of the printing plate 137 further continues to lie against the jacket surface of the printing cylinder 12 symmetrically to the tangential line 144 (FIG. 10). At the same time the pressure device 107 performs a pressing movement with its movable arms 113, 114 and 122, 123, which takes place in an oscillating fashion in respect to the tangential line 144 and takes up the maximum positions VI and VII shown in dashed lines in FIG. 11, while the upper and lower part of the printing plate are kept taut by the suction device. In this way pressing the printing plate down is performed free of bubbles and wrinkles.

Printing plates 137 of a length which takes up the major part or the entire circumference of the printing cylinder 12 are illustrated in FIGS. 10 and 11. For such cases, a groove 146 extending in the axial direction is provided below the suction guide 104 on the mechanical stage 78 or the pivot support 66, which receives the rolled-up end of a long printing plate 137. The printing cylinder 12 is put into motion in a clockwise direction in accordance with the arrow shown by the drive 19, 21, 26, so that the end of the printing plate 137 comes to rest against the printing cylinder 12, along with a simultaneous oscillating movement of the pressure device 107 with the pressure roller 116 around the tangential line 144 on the front, i.e. the print side of the printing plate. Because of the coating of foam rubber on the jacket surface of the pressure roller 116, it is possible to even out height differences of 0.7 to 3.5 mm in the relief of the printing plate 137, so that an even pressure is exerted.

The pressure roller 116 can consist of a plurality of individual disks arranged adjacent each other in an axial direction and individually resiliently seated, which therefore specifically press the printing plate 137 against the printing cylinder 12. Also, the pressure roller 116 can be embodied as a brush roller.

Figure 14:
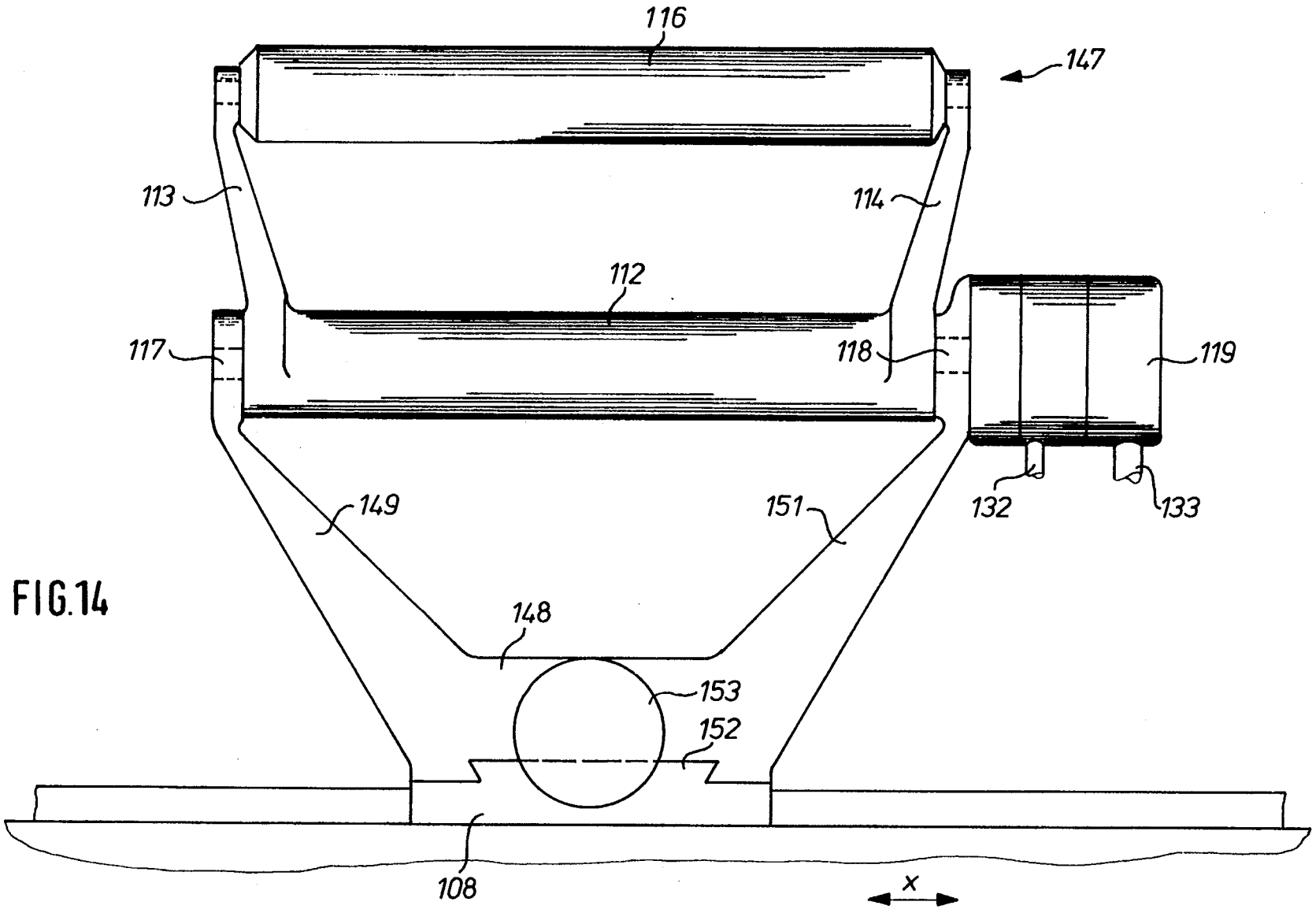
FIG. 14 is a second preferred embodiment of a pressure device in accordance with the present invention.
Figure 15:
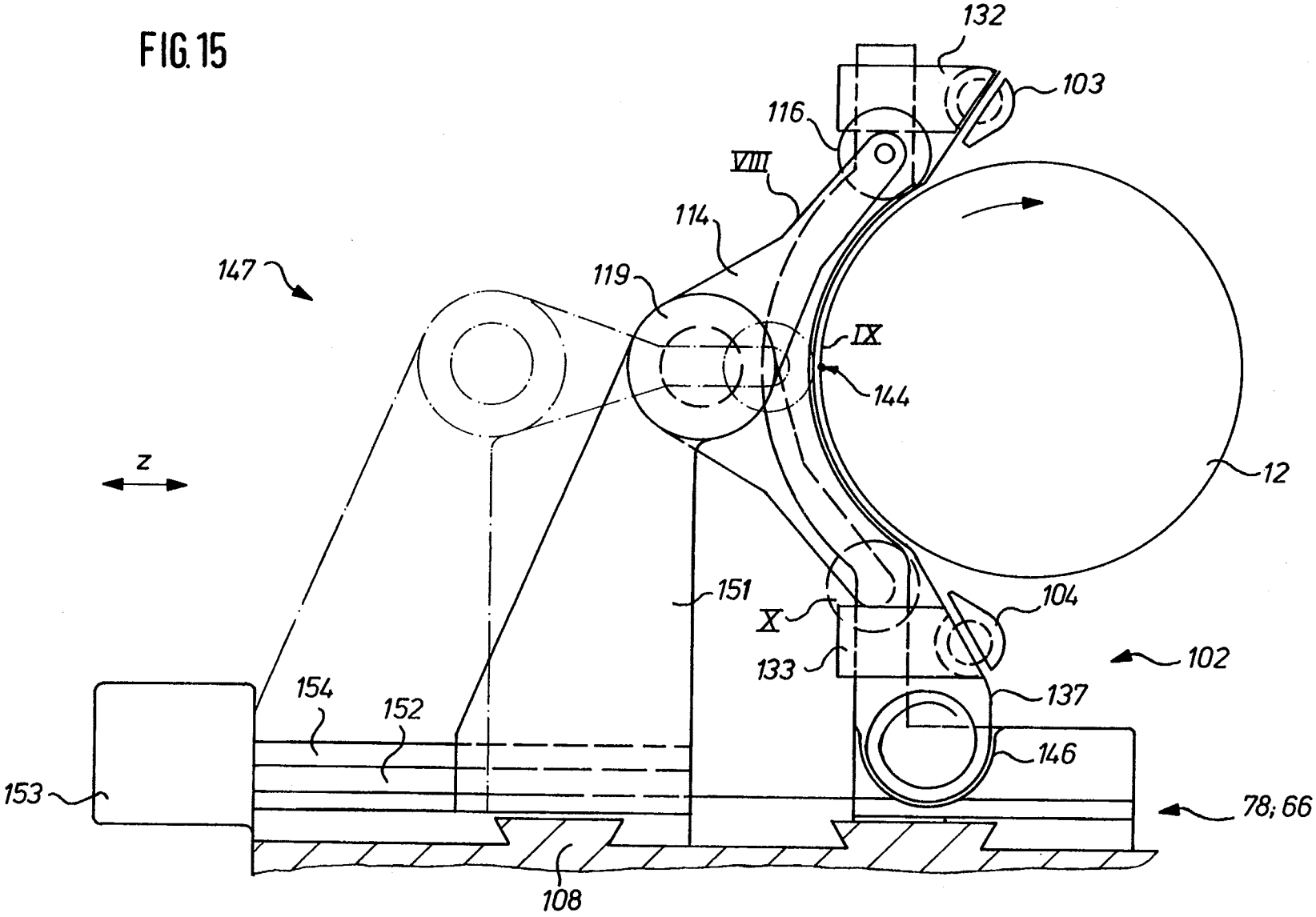
FIG. 15 is the side elevation view in accordance with FIG. 14, and with the suction fork added.

In FIG. 14, there is shown a front view of a second preferred embodiment of a pressure device 147 in accordance with the present application, and which is shown in FIG. 15 in a side view, together with a suction fork 102. The pressure device 147 consists of two spaced arms 113 and 114, which are fixedly disposed on the ends of a pivotable base body 112 and which receive a pressure roller 116 between their free ends. The pressure roller 116 can have a resilient jacket or can be structured as previously described. The base body 112 can be generally tube-shaped and has an axle journal 117 or 118 on each of its two ends. The axle journal 118 is connected, fixed against relative rotation, with a pivot drive 119. A generally V-shaped base body 148, which is movable in the direction of the arrow Z, has diverging arms 149 and 151. The free ends of arms 149 and 150 are seated rotationally movable on the axles 117 and 118. The base body 148 can be a hollow section and is movable on its base on a linear guide 152 in the direction of the arrow Z as shown most clearly in FIG. 15. A motor 153 and a threaded spindle 154 inserted into the base body 148 is used to accomplish this movement. The linear guide 152 is disposed on the support 108 which is movable in the direction of the arrow X.

Besides the pressure device 147, FIG. 15 shows the suction fork 102. The arm 114 supporting the pressure roller 116 is shown in solid lines in position VIII, which is in the upper maximum position for pressing the printing plate 137 down. Where the pressure roller 116 touches the tangential line 144, its position is shown as position IX. The arms 149 and 151 of the base body 148 are moved on the linear guide in the direction Z away from the printing cylinder 12, and then slowly back towards the printing cylinder 12 in the direction Z so that the pressure roller 116 takes up the position X shown in dashed lines.

Figure 16:
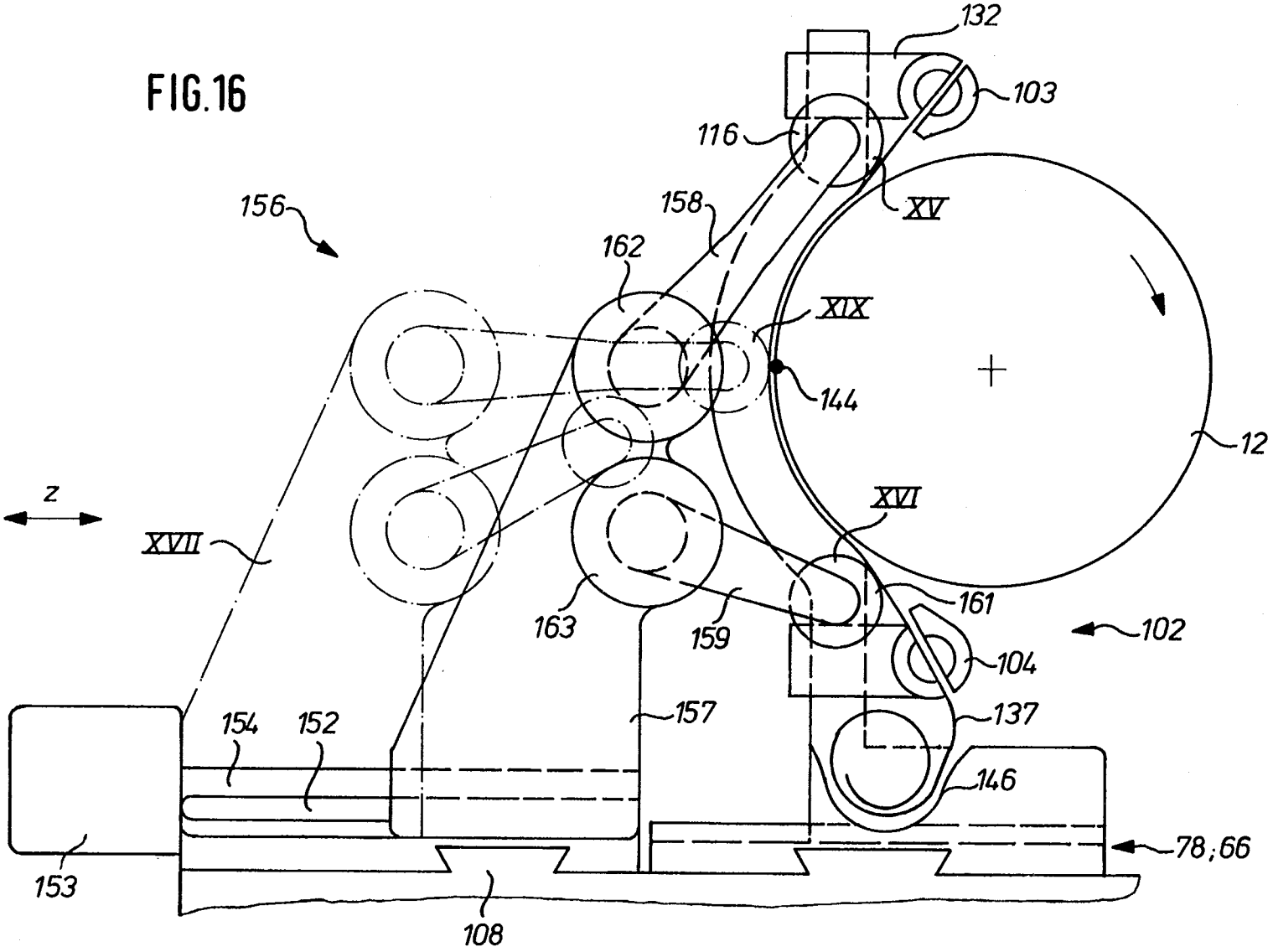
FIG. 16 is a side elevation view of a third preferred embodiment of a pressure device in accordance with the present invention.

In FIG. 16 a third preferred embodiment of a pressure device in accordance with the present invention is shown generally at 156. A base body 157 can be moved in the direction Z back and forth in respect to the printing cylinder 12 by means of a linear guide 152, a motor 153 and a threaded spindle 154. Two pivotable pairs of arms 158 and 159 are provided on the base body 157, with each pair of arms being of a different length. Between the pair of arms 158 there is supported a rotatable pressure roller 116 which is shown in the upper pressing position XV in FIG. 16. Between the pair of arms 159 there is supported an identical pressure roller 161 which is shown in the lower pressing position XVI. The mode of operation of this pressure device 156 is as follows: the base body 157 is first placed in the position XVII shown in dashed lines, in which the longer, upper pair of arms 158 touches the printing plate 137 with its pressure roller 116 at the tangential line in position XIX and presses it against the cylinder 12. Because of the continued movement of the drive 152, 153 and 154 of the base body 157 in the direction toward the printing cylinder 12, the upper pair of arms 158 with the pressure roller 116 moves in the direction toward the position XV. Also, because of the continued movement of the base body 157 toward the printing plate 12, the shorter, lower pair of arms 159 touches the printing plate 137 with its pressure roller 161 below the tangential line 144 and moves in the direction toward the position XVI until the printing plate 137 is placed on the printing cylinder 12 as far as that point, also.

If, because of its length, the printing plate 137 is not yet completely glued or adhered to the cylinder 12, the printing roller 12 is rotated in the direction of the arrow shown in FIG. 16 until the printing plate has been completely placed on the roller while being pressed by pressure assembly 156 against it. As previously described, the pairs of arms 158 and 159 can be operated by means of pivot drives 162 and 163, together with the linear drive assembly 152, 153 and 154.

Figure 17:
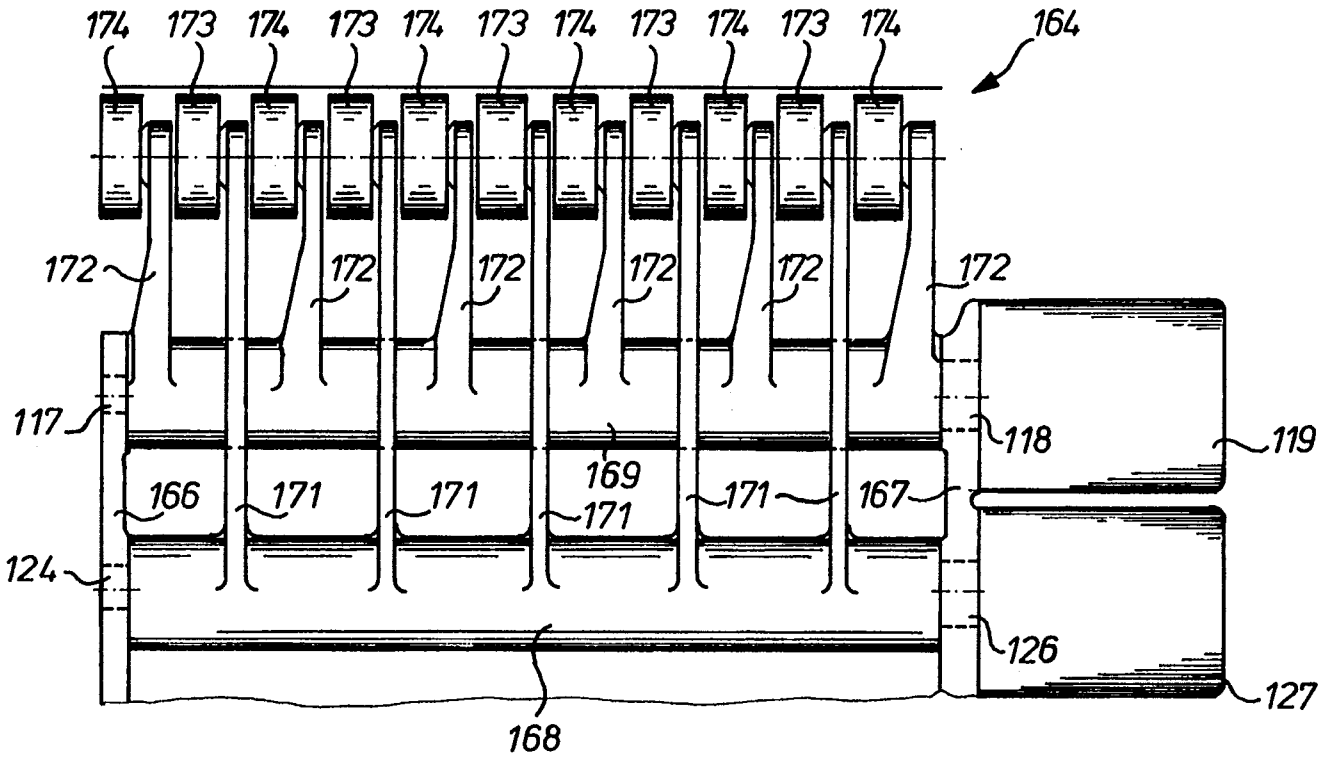
FIG. 17 is a top plan view of a fourth preferred embodiment of a pressure device taken in the direction indicated at A in FIG. 18, but without an illustration of the suction fork.
Figure 18:
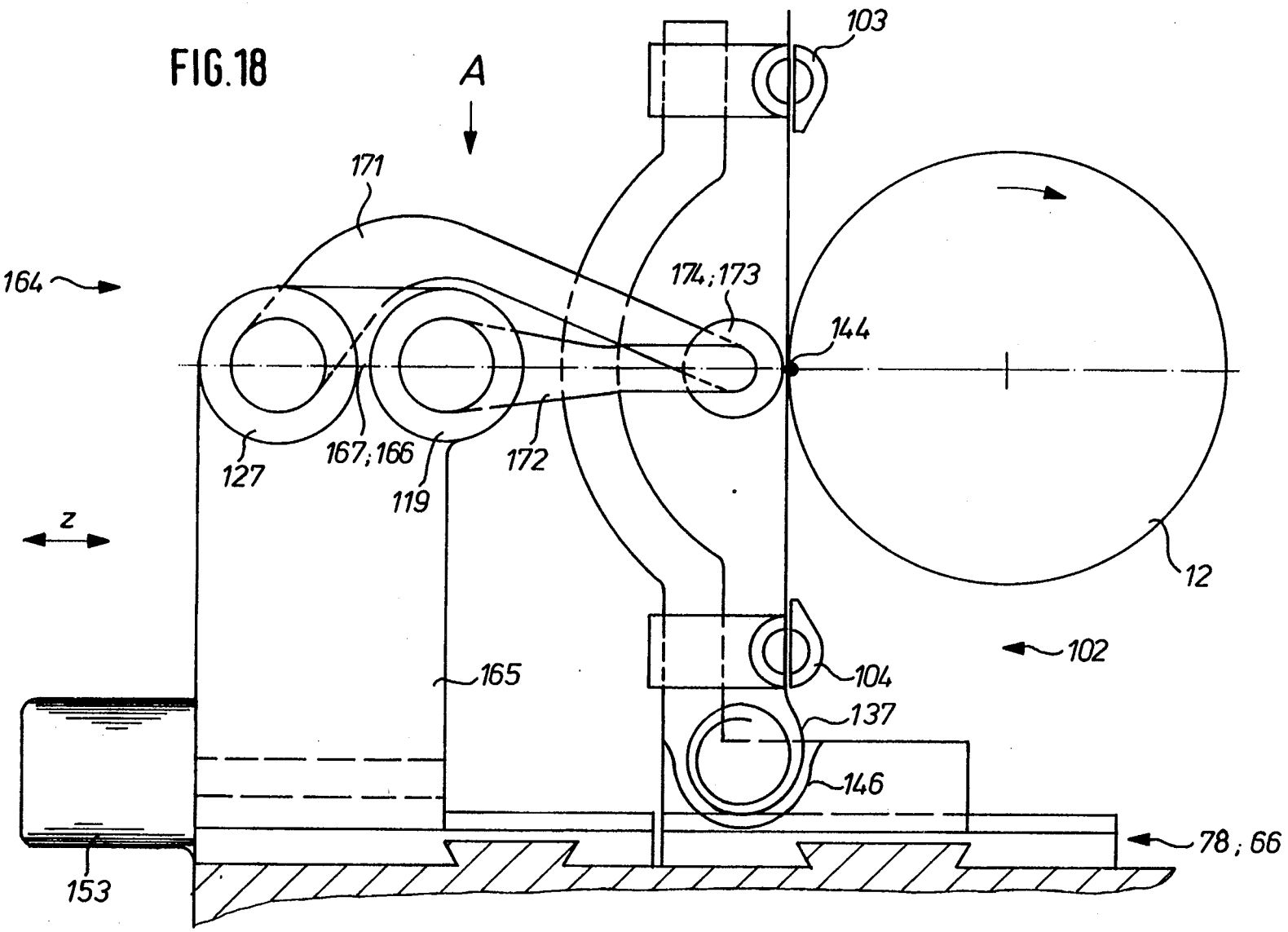
FIG. 18 is a side elevation view in accordance with FIG. 17, and showing the suction fork in the starting position.
Figure 19:
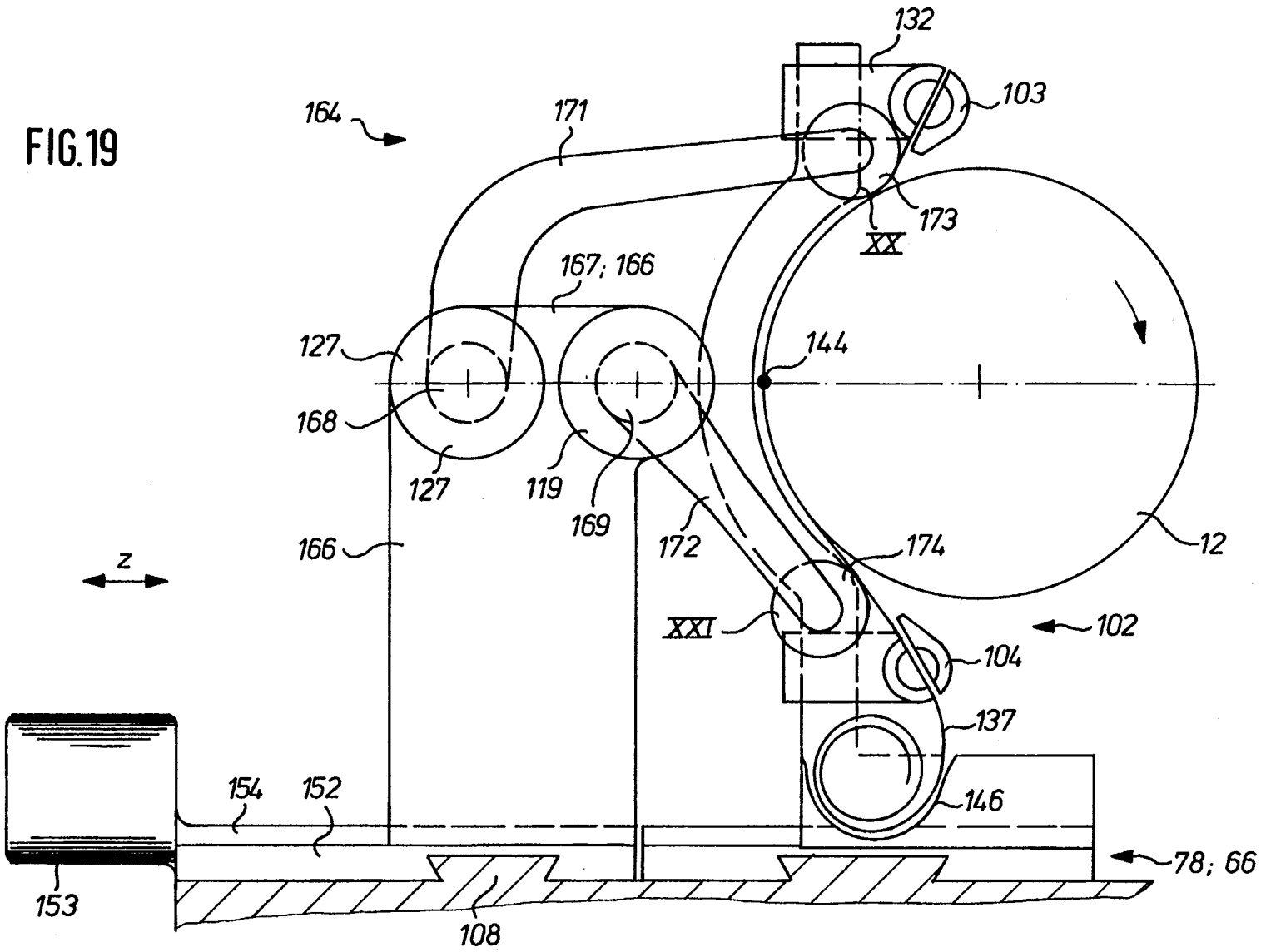
FIG. 19 is a side elevation view similar to FIG. 18, and with the printing plate already applied.

A fourth preferred embodiment of a pressure device in accordance with the present invention is shown generally at 164 in FIGS. 17 to 19. This pressure device 164 consists of a base body 165 which, as previously described, can be moved by its base in the direction Z back and forth with respect to the printing cylinder 12 on a linear guide 152 by means of a motor 153 and a threaded spindle 154. The linear guide 152 is supported on a support bed 108, which can be moved in the axial direction X. The base body 165 has two rigid arms 166 and 167, between which two tube-shaped base bodies 168 and 169 are rotatably seated above each other and with their axes parallel by axle journals 124 and 126 or 117 and 118. The journals 118 and 126 of the bodies 168 and 169 are connected, fixed against relative rotation with their respective base bodies 169 and 168 as well as with a respective rotary drive 119, 127. Each of the tube-shaped base bodies 168 and 169 has a number of fixed arm-like holders 171 and 172 which are spaced at a distance from each other and which extend vertically with respect to their respective base body 168 or 169. These holders 171 and 172 receive at their free ends pressure wheels 173 and 174, which are rotatable on shafts, not specifically shown.

The holders 171 and 172 are offset axially from each other and the holders 171 are longer than the holders 172. The holders 171 and 172 are spaced on their associated base bodies 168 and 169 in such a way that they interdigitate in a comb-like manner.

The mode of operation of this fourth preferred embodiment of the pressure device 164 is as follows; as seen in FIG. 18, a printing plate 137 is held by the suction guides 103, 104 and is brought into contact with the printing cylinder 12 by moving the suction fork 102 toward the tangential line 144. At the same time the pressure roller formed of the pressure wheels 173, 174, comes into contact with the printing plate 137 at the tangential line 144. Through continued movement of the suction fork 102 in the direction toward the printing cylinder 12, the contact of the plate 137 on the circumference of the cylinder 12 on both sides of the tangential line 144 of the printing cylinder 12 is increased. Simultaneously, the holders 171 and 172 pivot away from the tangent line 144 in respectively different directions by means of their rotary drives 127 and 129. The upper holder 171 with the pressure wheels 173 moves upward in the direction towards the beginning of the printing plate into the position XX, and the lower holder 172 with the pressure wheels 174 moves into the position XXI in the direction towards the lower end of the printing plate, as seen in FIG. 19. If the printing plate 137 is longer than shown in FIGS. 18 and 19, the printing cylinder 12 in FIG. 19 can be rotated in the direction of the arrow, so that the printing plate 137 is completely applied to cylinder 12. At the conclusion of this process, the pressure wheels 173, 174 are brought back into a common position, as shown in FIG. 18.

Figures 20, 21:
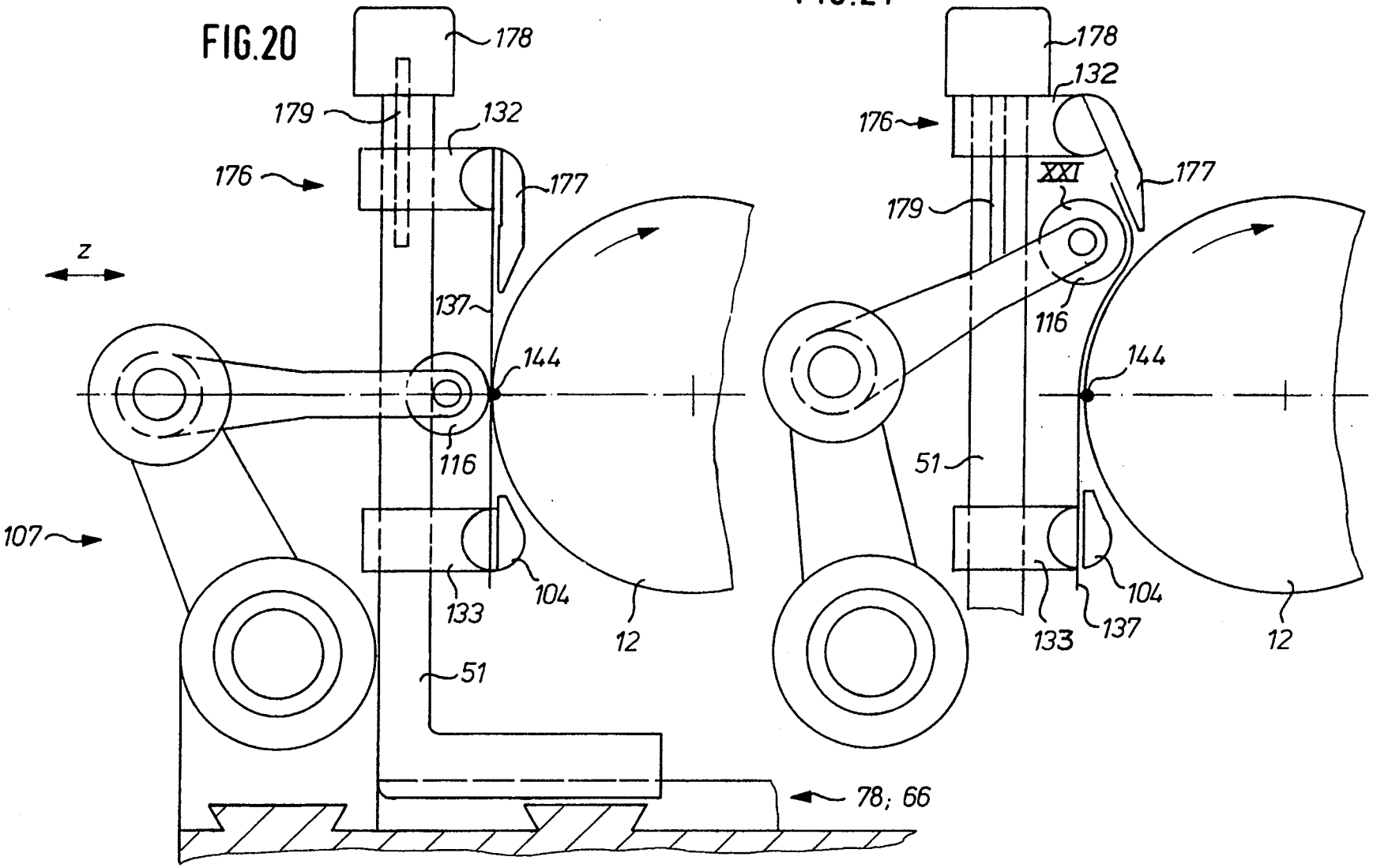
FIG. 20 is a side elevation view of a second preferred embodiment of a suction fork.
FIG. 21 is a view similar to FIG. 20 with the printing plate already partially applied.

A second preferred embodiment of a suction fork for use in the present invention is shown generally at 176 in the illustrations in FIGS. 20 and 21. This suction fork 176 includes a vertical column 51 with two spaced, horizontally extending holders 132 and 133. Suction guides 177 and 104 are seated rotatingly movable in the holders 132 and 133. The suction guide 177 differs from the suction guide 104 in that the suction guide 177 has a greater length in cross section. This greater length is understood to be a greater distance between the ends of the suction surface 136 at its wedge-shaped tip and the axis of rotation in accordance with FIGS. 12 and 13. In this way, the distance traveled by the beginning of the printing plate 137 on the pivotable suction guide 177 when being placed on the printing cylinder 12 becomes greater and in this way the beginning of the printing plate 137 is held longer slidingly by the suction guide. A motor 178 is located at the upper end of the column 51, and is used to render the holder 132 adjustable in the vertical direction by means of a threaded spindle 179. The mode of operation is as follows: as shown in FIG. 20, the printing plate 137 is brought against the printing cylinder 12 at the tangential line 144 by the driven movement of the mechanical stage 78 in the direction Z. A pressure device in accordance with FIG. 9 presses the printing plate 137 with its pressure roller 116 against the tangential line 144 and subsequently moves in the direction of position XXI in FIG. 21. To the same extent that the pressure roller 116 moves from the tangential line 144 in the direction toward the beginning of the printing plate toward the position XXI, the adjusting drive 178 and 179 brings the holder 132 with the suction guide 177 up and thus clears the way for the pressure roller 116. As soon as the beginning of the printing plate 137 rests on the jacket of the printing cylinder 12, the pressure roller 116 moves back into the position at the tangential line 144, as shown in FIG. 20 and the printing cylinder 12 rotates in the direction of the arrow shown until the end of the printing plate has been applied to the jacket of the printing cylinder 12.

Figure 22:
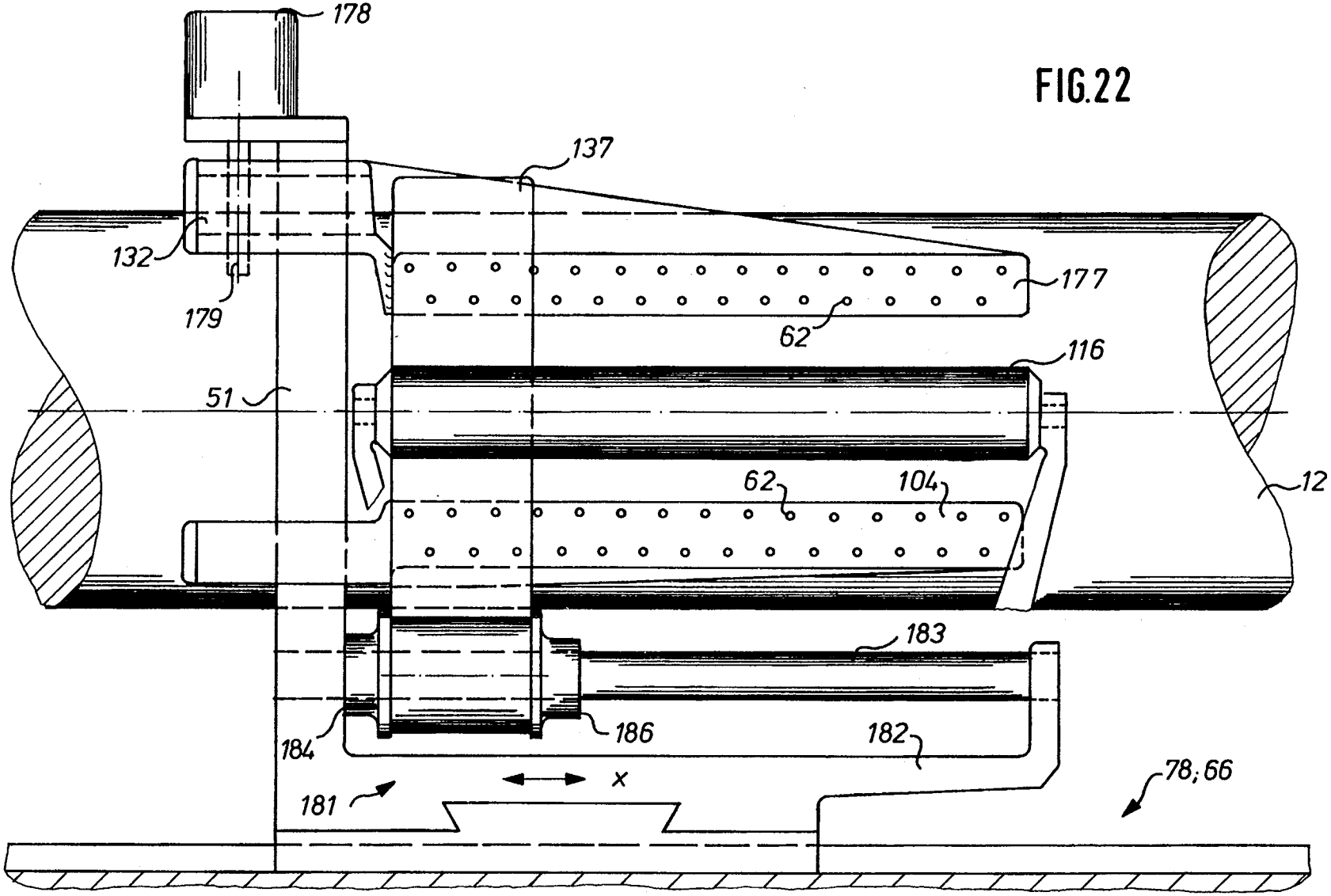
FIG. 22 is a front view of a device for winding long printing plates in accordance with the present invention.
Figures 23, 24:
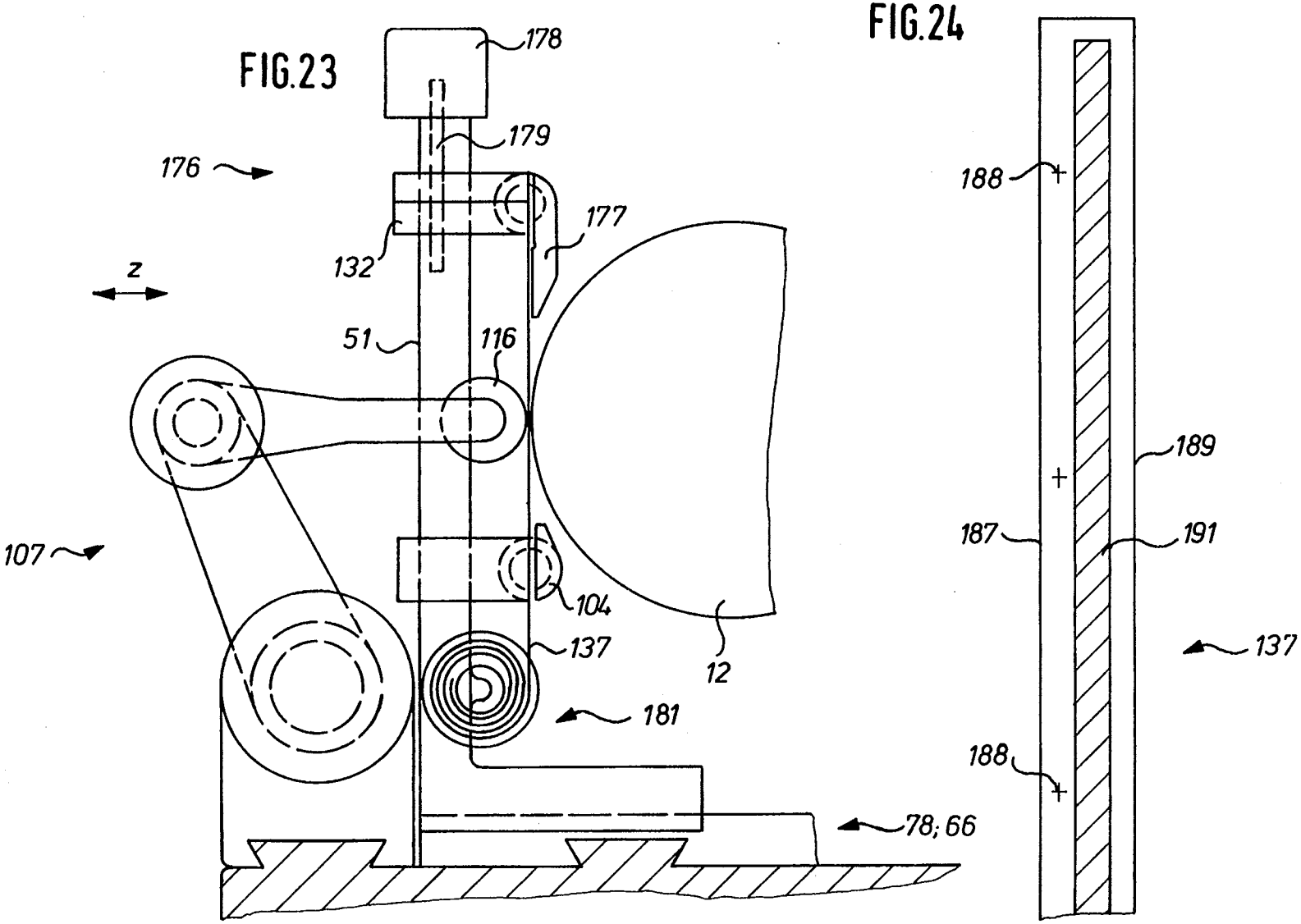
FIG. 23 is a side elevation view in accordance with FIG. 22.
FIG. 24 is an illustration of a long, strip-shaped printing plate usable with the present invention.

A device for rolling up long, preferably strip-shaped printing plates 137 is shown generally in FIGS. 22 and 23. The device for pressing the printing plate 137 down corresponds to the pressure device 107 of FIGS. 20 and 21, and the suction fork also corresponds to the suction fork 176 of FIGS. 20 and 21. A spool 181 is provided in place of a groove 146 for receiving a supply roll of a long printing plate 137. This spool 181 consists of a spindle 183 with lateral disks 184 and 186 spaced apart from each other. The shaft 183 is received on a first end by the column 51 and at a second end by a support arm 182 fixedly attached on the column 51. A strip-shaped printing plate 137 is wound between the disks 184 and 186. In accordance with FIG. 24, the strip-shaped printing plate 137 must have a straight longitudinal edge 187 and a longitudinal edge 189, which respectively have the same distance from the registration crosses 188. The second longitudinal edge 189 should suitably also extend parallel to the longitudinal edge 187. The relief 191 is located between the two longitudinal edges 187, 189. The strip-shaped printing plate 137 is aligned with the registration crosses 188 and the longitudinal edge 187 and is guided between the lateral disks 184, 186, which are displaceable on the spindle 183. A long, strip-shaped printing plate in the meaning of this invention is a printing plate which is applied to a printing cylinder 12 with a circumference of at least 1,000 mm in the radial direction.

While preferred embodiments of a method and apparatus for the accurate registering and mounting of printing plates in accordance with the present invention have been set forth fully and completely hereinabove, it will be apparent to one of skill in the art that a number of changes in, for example, the overall size of the printing cylinder, the specific types of drive motors used, the pitches of the lead screws and the like could be made without departing from the true spirit and scope of the present invention which is accordingly to be limited only by the following claims.

I claim:

1. A method for accurately registering and mounting a flexible printing plate on a plate cylinder of a printing press, said method including the steps of:

providing a shiftable suction fork assembly having spaced upper and lower suction arms for supporting a flexible printing plate;

placing a flexible printing plate on said shiftable suction fork assembly so as to be supported by said upper and lower suction arms;

using a registration screen to shiftably position said suction fork assembly for accomplishing accurate registering of said printing plate using said registering screen as a guide;

shifting said suction fork assembly with said printing plate thus supported and registered thereon into adjacency with a printing cylinder;

moving said suction fork assembly until said printing plate contacts a peripheral surface of said plate cylinder along a line of contact;

positioning a pressure applying device adjacent said printing plate; and using said pressure applying device to apply uniform application pressure to said printing plate starting at said line of contact and extending about a circumferential surface of said plate cylinder.

2. The method of claim 1 further including the steps of supporting a long printing plate to be applied to a plate cylinder on said shiftable suction fork assembly and rotating a printing plate cylinder while said pressure applying device is applying pressure to said printing plate for mounting said long printing plate on said plate cylinder.

3. An apparatus for the accurate registration and application of a flexible printing plate to a surface of a plate cylinder of a printing press, said apparatus comprising:

a machine frame usable to support a printing plate cylinder to which a flexible printing plate is to be applied;

a suction fork assembly having spaced suction arms for support of a flexible printing plate movably supported on said machine frame;

means to register a flexible printing plate positioned between said spaced suction arms;

a pressure device having a first pivot arm and at least one pressure roller secured on said first pivot arm;

means to shift said suction fork assembly to bring said printing plate supported thereon into a line contact with a circumferential surface of a plate cylinder;

means to position said pressure device with said at least one pressure roller in contact with said flexible printing plate; and means to move said at least one pressure roller about a circumferential surface of a plate cylinder to mount said printing plate to a surface of a plate cylinder.

4. The apparatus of claim 3 wherein said means to position said pressure device includes means to move said pressure device radially with respect to a plate cylinder.

5. The apparatus of claim 3 wherein said pressure device further includes a second pivot arm supporting a second pressure roller, said first and second pressure rollers being usable in combination to move along said printing plate on a plate cylinder from said line of contact toward ends of said printing plate.

6. The apparatus of claim 3 wherein said pressure device has first and second pivotable base bodies with each of said base bodies having a plurality of vertically disposed pivot arms which each supports a pressure roller, said pressure rollers on said plurality of pivot arms being axially aligned and interdigitated, said pressure rollers being movable from said line of contact toward ends of said printing plate to mount said plate on a plate cylinder.

7. The apparatus of claim 3 further including means on said suction fork assembly to support a portion of said printing plate which extends beyond said spaced suction arms.

8. The apparatus of claim 3 wherein said suction arms are rotatably supported on said suction fork assembly and have suction surfaces, an axis of rotation of each of said suction arms lying on a plane of said suction surface of each said suction arm.

* * * * *